US010119231B1

(12) United States Patent
Rohde et al.

(10) Patent No.: US 10,119,231 B1
(45) Date of Patent: Nov. 6, 2018

(54) ENERGY ABSORBING GUARDRAIL SYSTEM HAVING A MODIFIED FIRST UPPER POST

(71) Applicant: Safety By Design, Inc., Lincoln, NE (US)

(72) Inventors: John R. Rohde, Whitefish, MT (US); Dean L. Sicking, Indian Springs Village, AL (US); King K. Mak, San Antonio, TX (US); John D. Reid, Lincoln, NE (US)

( * ) Notice: Subject to any disclaimer, the term of this patent is extended or adjusted under 35 U.S.C. 154(b) by 0 days.

(21) Appl. No.: 15/972,300

(22) Filed: May 7, 2018

Related U.S. Application Data

(63) Continuation-in-part of application No. 15/618,188, filed on Jun. 9, 2017, now Pat. No. 9,963,844.

(51) Int. Cl.
*E01F 15/04* (2006.01)
*E01F 15/14* (2006.01)

(52) U.S. Cl.
CPC ..... *E01F 15/0492* (2013.01); *E01F 15/043* (2013.01); *E01F 15/143* (2013.01)

(58) Field of Classification Search
CPC . E01F 15/0438; E01F 15/043; E01F 15/0492; E01F 15/143; E01F 15/04; E01F 15/02; E01F 15/0415; E01F 15/0423; Y10S 256/05
See application file for complete search history.

(56) References Cited

U.S. PATENT DOCUMENTS 1,335,302 A * 3/1920 Stout ..... E04H 17/06 248/548
2,438,991 A * 4/1948 Camp ..... E01F 15/0438 248/66
4,655,434 A * 4/1987 Bronstad ..... E01F 15/143 256/13.1
5,022,782 A * 6/1991 Gertz ..... E01F 15/143 256/13.1
5,775,675 A * 7/1998 Sicking ..... E01F 15/0476 256/13.1
5,797,591 A * 8/1998 Krage ..... E01F 15/143 256/1
5,957,435 A * 9/1999 Bronstad ..... E01F 15/143 256/13.1
6,554,256 B2 * 4/2003 Ochoa ..... E01F 15/143 256/13.1

(Continued)

*Primary Examiner* — Jonathan P Masinick

(57) ABSTRACT

A highway crash attenuation system having W-beam rail elements attached to a plurality of vertical posts. An impact terminal with a feeder chute guides one or more of the W-beam rail elements through the impact terminal. The feeder chute has an impact shield extending along a traffic-facing side of the chute from an upstream-most end to a downstream-most end of the chute closing the traffic-facing side of the chute. The system also has an anchor cable release mechanism for releasing the cable downstream of the first vertical post and an improved first breakaway post. An improved upper section of Post 1 has an anchor bearing plate with a cooperating stabilizing bolt engaging with the upstream face of the upper post section. The downstream side of the upper post section is provided with split, spaced-apart strut sections which do not obstruct the rear cable pass through notch.

7 Claims, 28 Drawing Sheets

(56) References Cited

U.S. PATENT DOCUMENTS

| | | | | |
|---|---|---|---|---|
| 6,715,735 | B2 * | 4/2004 | Bligh | E01F 15/143 256/13.1 |
| 7,147,088 | B2 * | 12/2006 | Reid | E01F 15/143 188/377 |
| 7,401,996 | B2 * | 7/2008 | Neusch | E01F 15/06 256/13.1 |
| 8,448,913 | B1 * | 5/2013 | Rohde | E01F 15/143 248/548 |
| 8,517,349 | B1 * | 8/2013 | Ross | E01F 15/143 256/1 |
| 2001/0013596 | A1 * | 8/2001 | Sicking | E01F 15/143 256/13.1 |
| 2003/0015695 | A1 * | 1/2003 | Alberson | E01F 15/0461 256/13.1 |
| 2003/0151038 | A1 * | 8/2003 | Alberson | E01F 15/0461 256/13.1 |
| 2003/0213946 | A1 * | 11/2003 | Alberson | E01F 15/0476 256/13.1 |
| 2006/0102884 | A1 * | 5/2006 | Rohde | E01F 15/06 256/13.1 |
| 2007/0063178 | A1 * | 3/2007 | Alberson | E01F 15/0453 256/13.1 |
| 2007/0063179 | A1 * | 3/2007 | Alberson | E01F 15/0453 256/13.1 |
| 2007/0215849 | A1 * | 9/2007 | Alberson | E01F 15/0423 256/13.1 |
| 2009/0272955 | A1 * | 11/2009 | Abu-Odeh | E01F 15/143 256/13.1 |
| 2009/0272956 | A1 * | 11/2009 | Abu-Odeh | E01F 15/143 256/13.1 |
| 2012/0056143 | A1 * | 3/2012 | James | E01F 15/06 256/13.1 |
| 2014/0110651 | A1 * | 4/2014 | Cox | E01F 15/04 256/13.1 |

* cited by examiner

Fig. 3C1
413
414
412
207
416
Fig. 3C2
412
414
416
Fig. 3C3
412
413
414
201
202
413
414
412
207
201
202

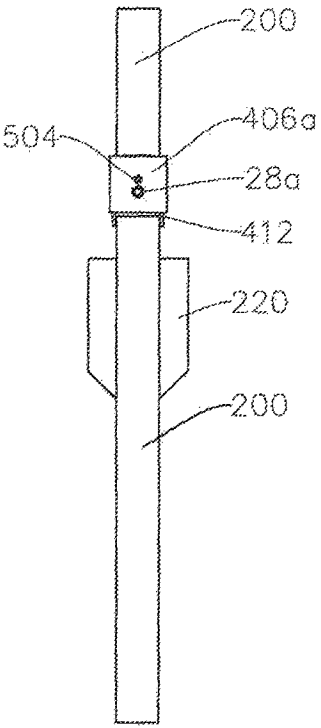
Fig. 13I
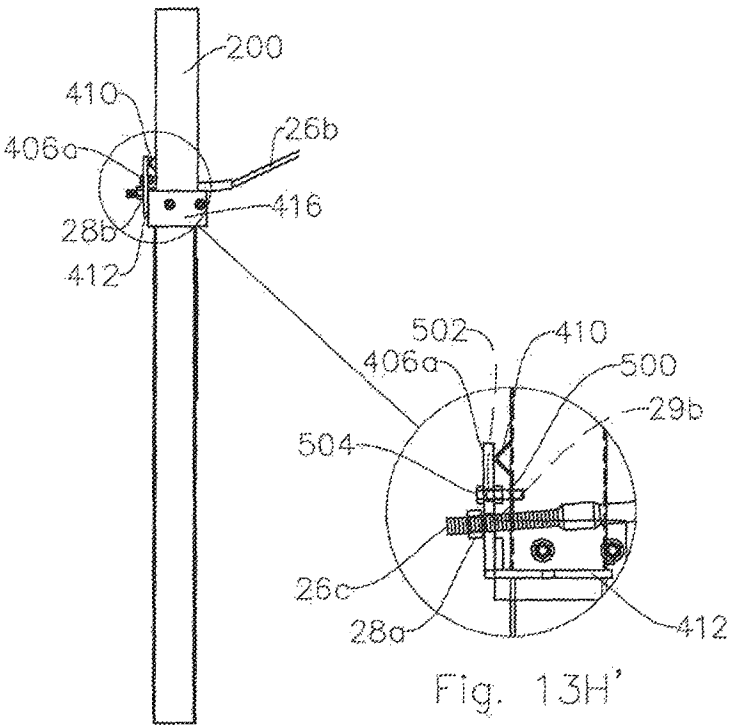
Fig. 13H'
Fig. 13H

ENERGY ABSORBING GUARDRAIL SYSTEM HAVING A MODIFIED FIRST UPPER POST

This is a continuation-in-part patent application, claiming priority to co-pending U.S. patent application Ser. No. 15/618,188, filed Jun. 9, 2017, which claims priority to continuation-in-part patent application U.S. patent application Ser. No. 14/414,644, filed 2015 Jan. 13, now U.S. Pat. No. 9,732,484B2, both of which are incorporated herein for all purposes.

BACKGROUND

The present invention relates to improvements to energy absorbing guardrail systems having end terminals, anchor cable release mechanisms, and breakaway posts used in cooperation with longitudinal, W-beam guardrail sectional barriers. These systems usually extend along highways and roadsides to absorb impact energy and deflect vehicles from hazards which may be associated behind the barriers. The present invention more specifically relates to systems having sequential kinking terminals (SKT) and flared energy absorbing terminals (FLEAT). More particularly, the present invention relates to an improved feed chute shield for the terminal; improved quick anchor cable release mechanisms; an improved breakaway post (Post 1) which facilitates breakaway in head-on impacts while resisting loads on side impacts; and an improved anchorage system that maintains tension in the W-beam rail after initial release of tension due to cable anchor release in order to reduce the propensity for the W-beam rail to buckle and form an elbow that may pose a hazard to the impacting vehicle. Each of these improvements may be incorporated into existing energy absorbing guardrail systems, alone or in combination, to improve the overall safety performance of the systems.

Impact heads of certain SKT, FLEAT, and other energy absorbing terminals do not have a shield to protect traffic-side exposure to the W-beam rail guide tube or feeder chute. For angled impacts in the area of the feeder chute, an impacting vehicle may potentially wedge into the opening of the existing prior art feeder chute. Such wedging may possibly cause the impacting vehicle to get hung up, thus, preventing smooth redirection of the vehicle. Wedging also may potentially snag vehicle parts in situations where it should be an easy gate-through. Such wedging, in turn, could lead to rollover of the impacting vehicle. Further, in the existing prior art feeder chute, the W-beam rail may buckle out of the traffic-side of the chute as the impact terminal head and the feeder chute are urged downstream by the impacting vehicle. When such buckling occurs the entire energy absorption process may stop.

An embodiment of the present invention provides a shield plate extending along the traffic-side of the chute substantially the entire length of the chute. This shield plate closes the traffic-side of the feeder chute and prevents impacting vehicles from wedging into the feeder chute. The closing shield also prevents the W-beam rail from buckling out the traffic-side of the chute as it is urged downstream along the W-beam rail element.

In the past either a heavy strap has been wrapped at the end of the feed chute or a heavier chute wall thickness is used to prevent cutting of the chute and/or W-beam railing as the chute travels downstream along the top and bottom edges of the W-beam upon vehicular impact. It has been discovered that utilizing inwardly rolled edges at the downstream end of the feed chute reinforces the chute and prevents such cutting as the chute travels downstream along the W-beam.

Existing SKT and FLEAT terminals depend on the break away of Post 1 to release the upstream end of an anchor cable. However, under certain impact conditions, Post 1 may not break away properly, thus not releasing the anchor cable. This in turn could result in snagging and excessively high deceleration of the impacting vehicle. In some cases during an end-on hit, after Post 1 released and lifted the anchor or bearing plate, the assembly got caught under the vehicle resulting in tears in the vehicle's floorboard.

The fact that the cable did not fully separate from the upper section of Post 1 appeared to be the cause of snagging and tearing problems. A present improvement to the first upper section of Post 1 provides a mechanism to positively lift the bearing plate off of the lower section of Post 1 and allow Post 1 to separate from the anchor cable.

An embodiment of the present invention provides for the release of the anchor cable at the downstream end (i.e., at the anchor release bracket) rather than relying on the breaking away of Post 1 to release the upstream end of the anchor cable. The improved anchor cable release mechanism includes a release arm attached to the anchor cable release bracket with a pivot bolt and alignment shear pins to release the anchor cable at the downstream end of the cable.

In another embodiment, a plurality of the improved anchor cable release brackets may be mounted to downstream sections of the guardrail with additional cable lengths swagged together to span from Post 1, through the first anchor release bracket, to the subsequent downstream anchor brackets. The upstream end of the anchor cable is attached permanently to Post 1. While the present disclosure discusses a system with two such anchor cable release brackets, it should be understood that more such brackets may be utilized to maintain tension in the W-beam rail element as the impact head is urged downstream on impact.

In a typical end-on impact with a single anchor cable release bracket, once the impacting vehicle pushes the impact head downstream, breaking away Post 1, and releasing the anchor cable from the first anchor cable release bracket and pushing the first release bracket off the W-beam rail, the tension in the W-beam rail is released. With the two (or more) anchor release bracket embodiment of the present invention, after the anchor cable is released from the first anchor bracket and the first bracket is pushed off the W-beam rail, the tension in the W-beam rail is maintained by the second (or other) anchor cable release brackets. The rail tension maintained through the release of subsequent brackets reduces the propensity for the W-beam rail to buckle and form an elbow that may pose a hazard to the impacting vehicle. Thus, the rail tension is maintained until the impact head releases the subsequent anchor brackets and releases the downstream-most end of the anchor cable.

In an embodiment of the present invention, a supplemental anchor cable mechanism is provided to maintain tension in the W-beam rail after release of the primary anchor cable. The supplemental anchor cable system is designed to reduce the propensity of the W-beam rail to buckle in end-on impact at an angle.

An additional and separate anchor for the supplemental anchor cable mechanism may be installed upstream of the impact head. In yet another embodiment, this supplemental mechanism is incorporated into the Post 1 anchor as will be described below. The supplemental anchor cable may be attached to the additional anchor at its upstream end, extend through the impact head, and may be retained by a bracket attached to an upstream end of the W-beam rail. Sufficient slack is provided in the supplemental anchor cable length so that the supplemental cable is not tensioned until it becomes taut.

Testing of end-on impacts shows that after the primary anchor cable is released from the cable anchor release mechanism, tension in the W-beam rail is released until the supplemental anchor cable becomes taut. At that point, tension in the W-beam rail is re-established by the supplemental anchor cable system.

In earlier Post 1 designs, Post 1 was intended to breakaway when the post was impacted from a head-on direction, but the post had limited lateral strength. Thus, for side impacts just downstream of Post 1, the earlier Post 1 design sometimes resulted in unintentional break away allowing the impacting vehicle to gate through the terminal and go behind the guardrail installation. An embodiment of the present invention provides for an improved post design that still allows Post 1 to break away in head-on impact, while providing added lateral strength to accommodate side impacts just downstream of Post 1.

An alternative embodiment of the present invention utilizes the anchor cable release bracket disclosed and claimed in U.S. Pat. No. 8,448,913, but utilizes an improved upstream anchor cable release mechanism.

BRIEF DESCRIPTION OF THE DRAWINGS

FIG. 2B' illustrates in detail an inwardly rolled edge on the improved feeder chute.

FIG. 3B' illustrates a side elevation view of the improved, upstream anchor cable attachment mechanism of FIG. 3B in rotation with the upper section of Post 1 rotating and lifting off the lower post section of Post 1.

FIG. 3C$^1$ shows a top view of the lower post section of FIG. 3C.

FIG. 3C$^2$ shows a bottom view of the lower post section of FIG. 3C.

FIG. 3C$^3$ shows a side elevation view of the top of the lower post section of FIG. 3C.

FIG. 7A shows the mechanism before vehicular impact. FIG. 7B shows the feeder chute engaging the sloped section of the release arm. FIG. 7C shows the arm fully pivoted and the anchor cable released. FIG. 7D shows the anchor bracket impact shoulder engaging and releasing the bracket from the W-beam rail.

FIGS. 7A'-7D' illustrate details of portions of FIGS. 7A-7D.

FIG. 8A shows the mechanism before vehicular impact. FIG. 8B shows the cable release strut on the downstream end of the feeder chute engaging the sloped section of the release arm. FIG. 8C shows the arm pivoting as it releases the end of the cable (cable not shown for clarification purposes). FIG. 8D shows the bracket release shoulder engaging and releasing the bracket from the W-beam rail element.

FIG. 10C is a front elevation view of the upper section of Post 1 showing a front lower slot; a bearing plate bolt hole; and the angle iron spacer.

FIG. 10D illustrates a side elevation view of the upper section of Post 1 of FIG. 10B.

FIG. 10E illustrates a rear elevation view of the upper section of Post 1 of FIG. 10B.

FIG. 13A shows the initial position prior to impact. FIG. 13B shows the upper section rotating or pivoting in a downstream direction with the upper section lip pivoting about the lower section strut. FIG. 13C shows the upper section disengaging from the lower section.

FIG. 13E shows a side elevation view of the plate on the ledge. FIG. 13F is a front (upstream) side elevation view of the plate resting on the ledge or shelf in a proper alignment. FIG. 13G shows how the plate may rotate without the support of the ledge or shelf.

FIG. 13H is a side elevation view of an alternative embodiment of the anchor cable release mechanism with a stabilizing bolt passing through the anchor bearing plate and engaging the upper post section of Post 1.

FIG. 13H' is a detailed view of the anchor bearing plate, the anchor cable, and the anchor stabilizing bolt.

FIG. 13I is an upstream, elevation view of Post 1 with the embodiment of the anchor release mechanism having the stabilizer bolt to reduce the likelihood of the anchor bearing plate rotating upon impact.

FIGS. 14A-14D correspond equivalently to FIGS. 13A-13C.

DETAILED DESCRIPTION

Figure 1A:
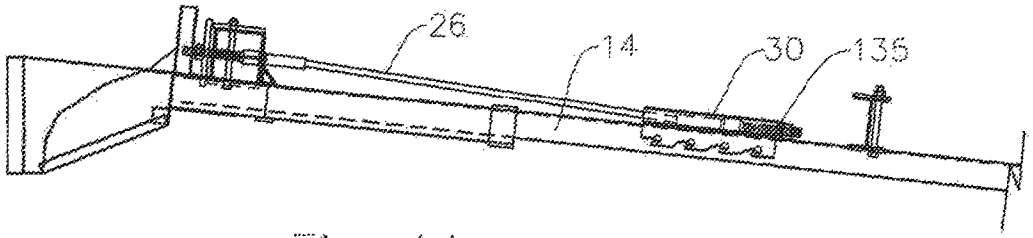
Fig. 1A PRIOR ART
FIG. 1A shows a top view of the prior art highway guardrail system of FIG. 1.
Figure 1:
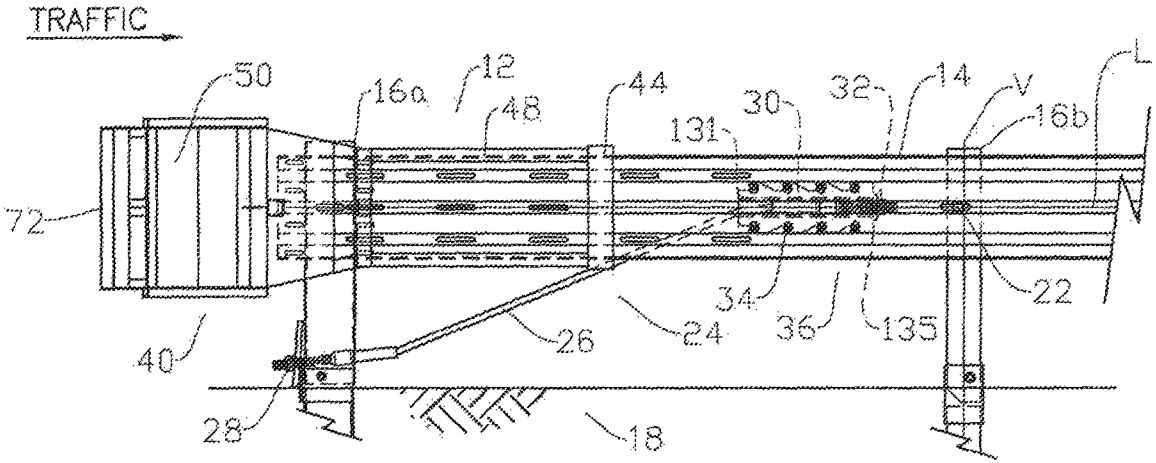
Fig. 1 PRIOR ART
FIG. 1 illustrates a side elevation view of a prior art highway guardrail system.

Referring now to the drawings, and more particularly to FIG. 1 which shows prior art, the reference numerical 12 generally represents an energy dissipating guardrail terminal. The terminal is adapted to be connected to the upstream side of a conventional guardrail 14 consisting of standard W-beam guardrail sections. The guardrail sections or rail elements are attached along their vertical axes V by bolts 22 to a plurality of spaced apart vertical breakaway posts 16*a*-16*b*. Any suitable number of posts may be used depending upon the expanse of the guardrail run. FIG. 1 illustrates two steel breakaway posts. Steel posts downstream from lead posts 16*a* and 16*b* may be embedded directly into the soil 18.

FIG. 1 further illustrates the anchor cable mechanism 24 of the prior art (see U.S. Pat. No. 8,448,913 which is incorporated herein for all purposes) which includes an anchor cable 26, a lower anchor cable bolt 28, an anchor cable release bracket 30, an upper anchor cable button and cap 32, and eight anchor bracket attachment bolts 34. The anchor cable mechanism is provided to allow the terminal 12 to withstand angular vehicle impacts downstream of its upstream end 36.

It is intended that a vehicle will impact the guardrail 14 downstream of its upstream end 36; however, a collision with the upstream end 36 requires the provision of an end treatment 40 to reduce the extent of injury to the impacting vehicle and its occupants. The purpose of the end treatment is to dissipate impact energy of the vehicle. There are a number of existing prior art treatments which are compatible with the instant invention. Including, but not limited to, the sequential kinking terminal (SKT) and the bursting energy terminal (BEAT).

As seen in these prior art figures, the impact head portion 50 of the end treatment 40 is attached on the upstream end of a guide tube or feeder chute 48. Guide tube 48 is mounted onto lead post 16*a* by fasteners passing through post angle brackets. The upstream end of the W-beam rail element 14 extends into the guide tube 48. Guide tube 48 has an anchor bracket impact shoulder 44 with a leading tapered edge which impacts with the upstream end of anchor cable release bracket 30 when the impact head 50 is urged downstream upon a vehicular impact.

When the end treatment 40 is impacted end-on by an errant vehicle, an impact plate 72 will engage and interlock mechanically with the front of the vehicle. As the vehicle proceeds forward, the impact head 50 will be moved forward or downstream along the W-beam rail element 14. Post 16*a* is provided with a hole though which passes the upstream end of the anchor cable 26. When the impact head is displaced downstream in a collision, post 16*a* will snap or break, thus releasing the tension on the cable 26 of the anchor cable mechanism 24 at this upstream location.

At or shortly after breaking the lead post 16*a*, the upstream end of the W-beam rail element 14 will be treated within the impact head to dissipate impact energy. As the vehicle proceeds forward and pushes the impact head 50 along, the downstream end of the guide tube/feeder chute 48 reaches the upstream end of anchor cable release bracket 30 on the rail element 14. The anchor cable release bracket, which is held on the W-beam rail element 14 by the anchor cable release bracket attachment bolts 34, will be pushed forward, slide off the bolts 34, rotate out of parallel alignment with and be released from the W-beam rail element 14. This process is fully described in U.S. Pat. No. 8,448,913.

For impacts that are either end-on at a large angle or near the end of the end treatment 40 (e.g. between lead post 16*a* and cable anchor bracket 30), the impacting vehicle will break off posts 16*a* and/or 16*b*, bend the W-beam rail element, and gate behind the end treatment and guardrail installation.

For impacts into the side of the terminal downstream of the beginning of length-of-need, the terminal 12 will act like a standard guardrail section and will contain and redirect the impacting vehicle. The anchor cable mechanism will provide the necessary anchorage to resist the tensile forces acting on the rail element to contain and redirect the vehicle.

FIG. 1A is a top view of a prior highway guardrail system showing the anchor cable 26 attached to the lower portion of Post 1 and extending to a prior art anchor cable release bracket 30. Details of the structure and operation of the prior art cable release mechanism are taught and disclosed in U.S. Pat. No. 8,448,913 B1 issued May 28, 2013, which disclosure is incorporated herein for all purposes. The bracket 30 moves away from and out of parallel alignment with the W-beam rail element 14 beginning at a downstream end 135 of the prior art mechanism.

Figure 2A:
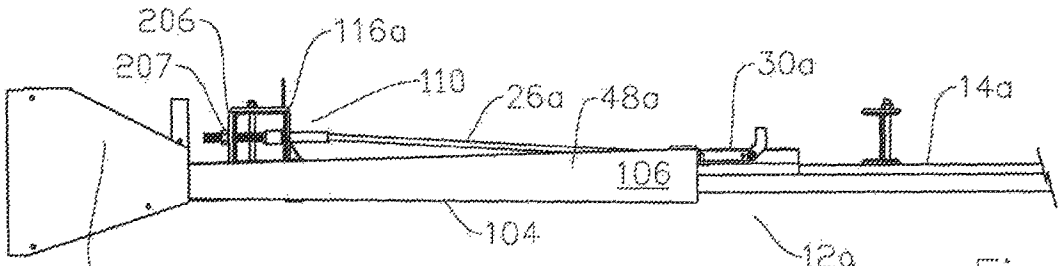
FIG. 2A is a top view of the guardrail system of FIG. 2.
Figure 2:
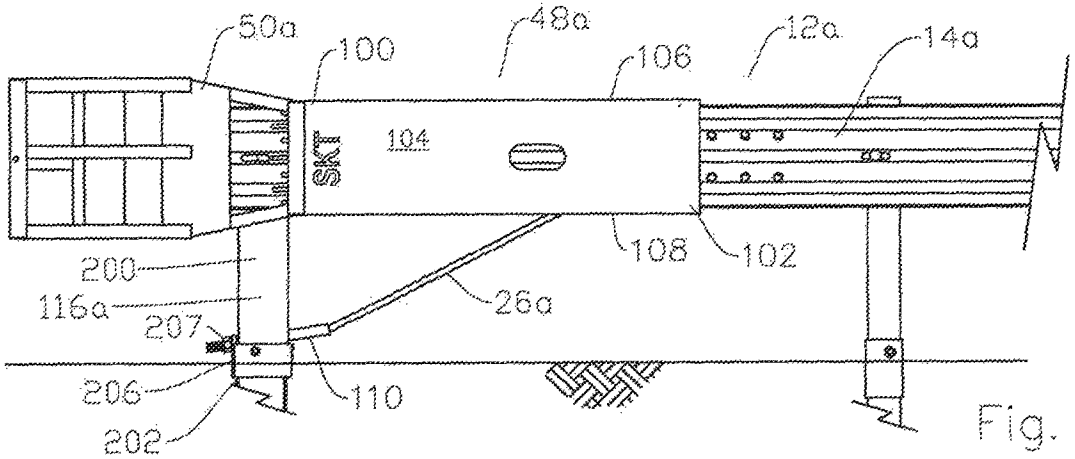
FIG. 2 shows a side elevation view of a sequential kinking terminal of the present invention with a feeder chute shield plate, an improved anchor cable release mechanism attached to a downstream section of a W-beam rail element, and an improved Post 1 design.

Turning now to the present invention, in FIG. 2, a side elevation view of a sequential kinking terminal 12*a* shows an embodiment of an improved guide tube/feeder chute 48*a* having an upstream-most end 100 and a downstream-most end 102. Extending along the traffic-side of the chute 48*a*, substantially the entire length of the chute and from the top of the chute 106 to the bottom of the chute 108 is a shield plate 104. Plate 104 covers this traffic-side of the chute from upstream-most end 100 to downstream-most end 102 and prevents an impacting vehicle from wedging into the feeder chute 48*a* and preventing the W-beam rail element 14*a* from buckling out the traffic-side of the chute 48*a* as terminal impact head 50*a* moves downstream along the W-beam rail element.

FIG. 2A is a top view of the guardrail system of FIG. 2 showing an improved anchor release mechanism 30*a* with an anchor cable 26*a* attached at an upstream end 110 to an improved Post 116*a* and to the improved anchor release mechanism 30*a* at downstream end. The upstream end 110 of cable 26*a* passes through a hole 221 (FIG. 11A) in a front side plate 206 attached to the upstream face of the lower post section 202 of post 116*a*. To retain the cable 26*a* and to keep it from pulling out of hole 221, a locking nut 207 is threadingly attached to the upstream most end of the cable 26*a*. Further details of the improved anchor cable release mechanism are described below.

Figure 2B:
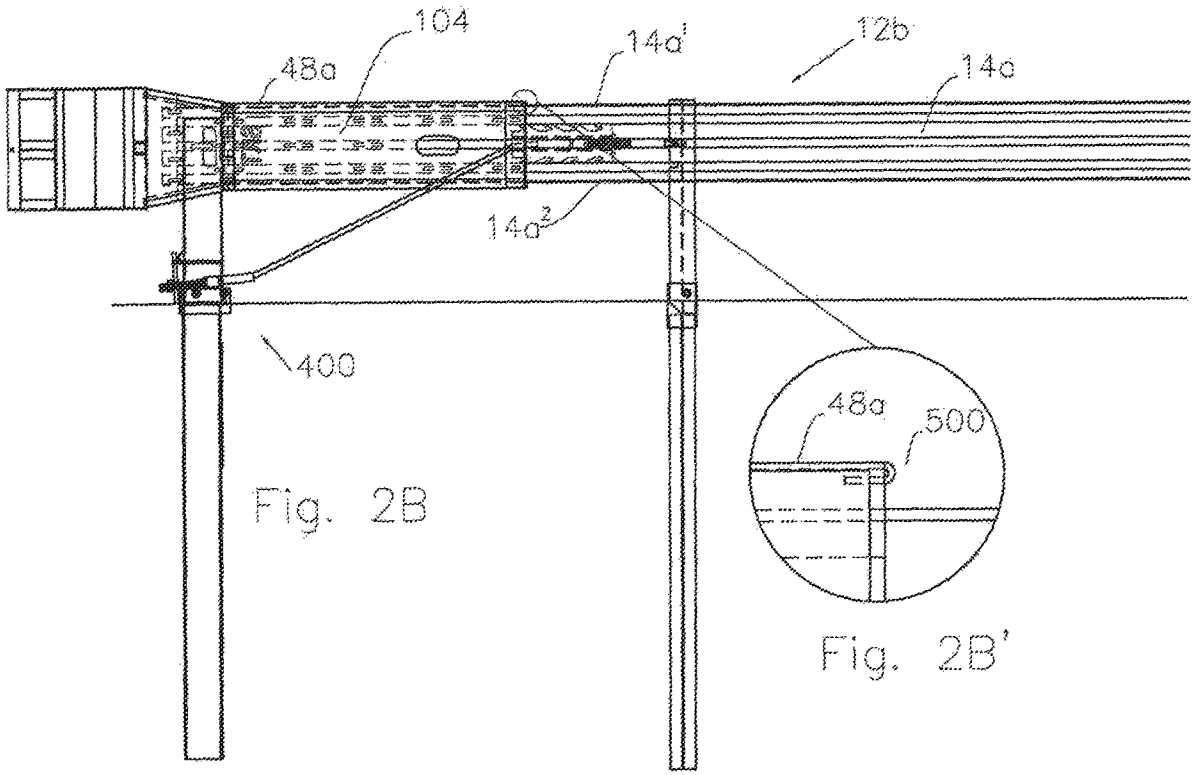
FIG. 2B illustrates a side elevation view of a highway guardrail system having an alternative embodiment of an improved, upstream anchor cable attachment mechanism and feeder chute with inwardly rolled edges.

FIG. 2B illustrates a side elevation view of a highway guardrail system 126 having an alternative embodiment of an improved, upstream anchor cable attachment mechanism 400 and which incorporates the shield plate 104 on the feeder chute 48*a*. The feeder chute 48*a* is provided with inwardly rolled edges 500 as shown in FIG. 2B[1]. The rolled edges 500 reduce the chance of cutting along the top 14*a*[1] and bottom 14*a*[2] of the W-beam 14*a*. Further details of the improved, upstream anchor cable attachment mechanism 400 will be described below.

Figure 3A:
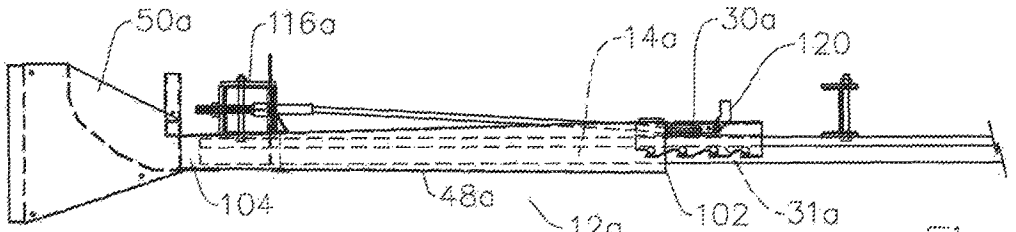
FIG. 3A is a top view of the guardrail system shown in FIG. 3.
Figure 3:
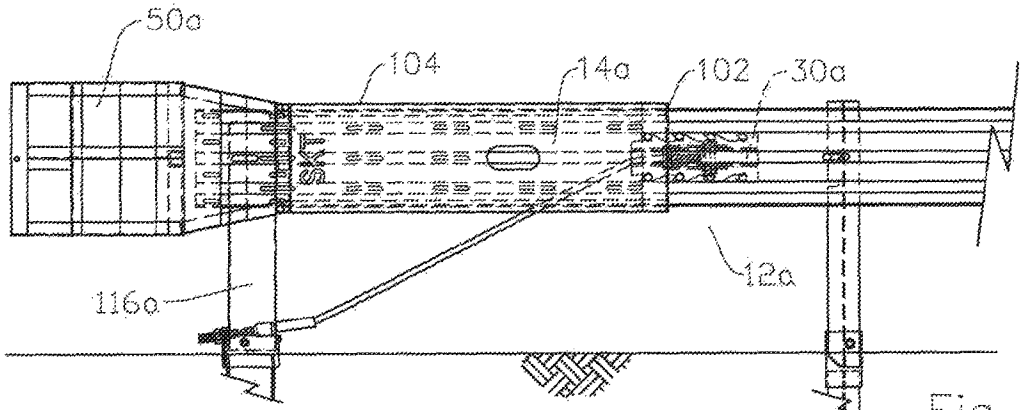
FIG. 3 is an illustration of the guardrail system of FIG. 2 with broken lines to show the improved anchor cable release mechanism and the W-beam rail behind the feeder chute shield plate.

FIG. 3 illustrates a guardrail system 12*a* of FIG. 2 with broken lines showing the anchor cable release mechanism

30*a* and the W-beam rail element 14*a* behind the feeder chute shield plate 104 more clearly visible.

FIG. 3A is a top view of the guardrail system of FIG. 3 showing anchor release arm 120 of the release mechanism 30*a* prior to engagement with the downstream end 102 of the chute 48*a*.

Figure 3B:
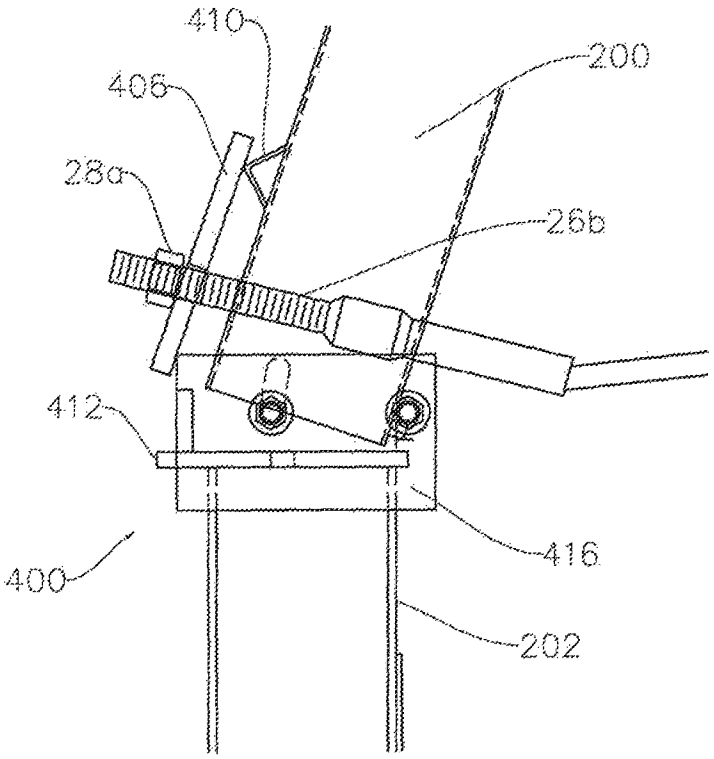
FIG. 3B illustrates a detailed side elevation view of an alternative embodiment of an improved, upstream anchor cable attachment mechanism, showing a section of angle iron between the anchor or bearing plate and the upstream face of the upper post section, a front lip or ledge beneath the anchor plate, the raised side walls with height above the centerline of the anchor cable, and the anchor cable passing through a through hole and notch in the upper post section.
Figure 3B:
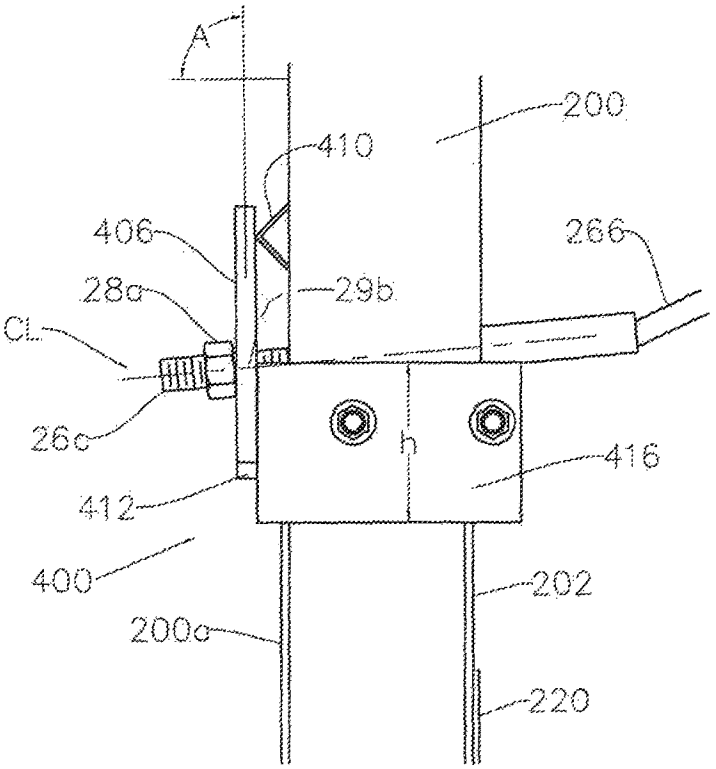

FIG. 3B illustrates a detailed side elevation view of an alternative embodiment of an improved, upstream anchor cable attachment mechanism 400. In some embodiments of the present invention, design parameters are such that it is desirable for the impact head 50*a* to knock off the anchor bracket 30 from the W-beam 14*a*. The attachment mechanism 400 facilitates release of the upper post section 200 from lower post section 202.

As may be seen in FIG. 3B, upper post section 200 is provided with a section of angle iron 410 on the upstream face 200*a* of post section 200. The angle iron 410 acts as a spacer between anchor bearing plate 406 and the upper post section 200. The spacer 410 enhances engagement of the bearing plate 406 with the lower post section 202. The size of the angle iron 410 urges the bearing plate to assume a predetermined angle (angle range of 0° to 70°) from the vertical. This angle significantly reduces the propensity of the bearing plate 406 to slip up and off the lower post section 202 during a redirective impact where the load is applied via the cable 266 to the bearing plate 406.

Figure 3C:
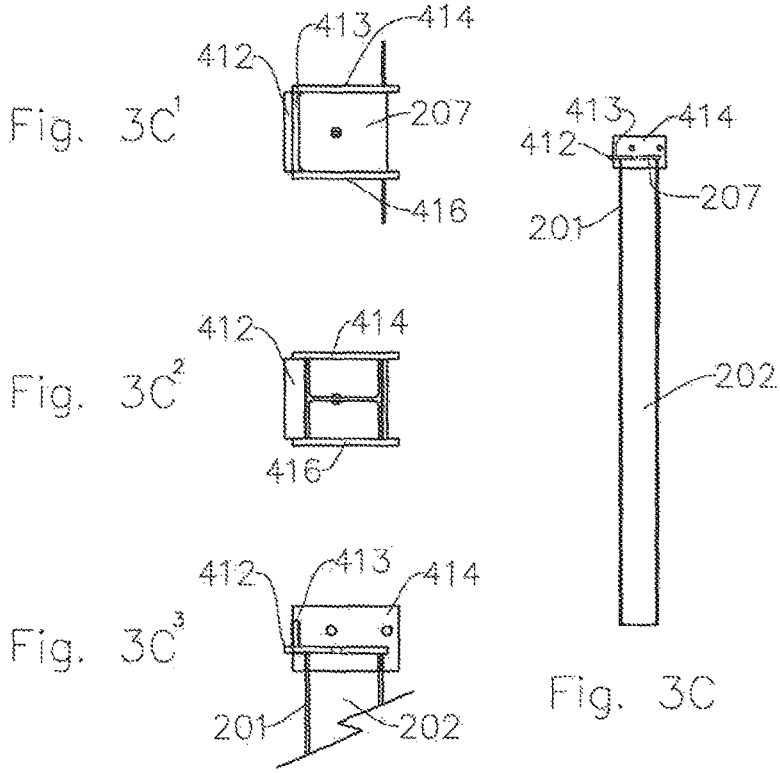
FIG. 3C illustrates a side elevation view of an alternative embodiment of a lower post section with a ledge or lip for supporting an anchor or bearing plate and upwardly extending side plates.

FIG. 3B also shows an L-shaped ledge or shelf 412 extending from the upstream face 201 of lower post section 202 upon which a lower edge of the bearing plate 406 rests atop of the ledge 412 to mitigate the rotation (see FIGS. 13E-13G) of the bearing plate 406, which may reduce the anchorage capacity of the system. FIG. 3C illustrates that the top 207 of the lower post section extends upstream of the face 201 of the lower post section to provide the ledge or shelf 412. FIGS. 3$C^1$-3$C^3$ illustrate top side, bottom side, and side elevation views of lower post section 202 showing the relationship of the ledge 412. A vertical crossmember 413 extends horizontally along an upstream portion of the top to complete the L-shaped shelf 412.

Figure 12B:
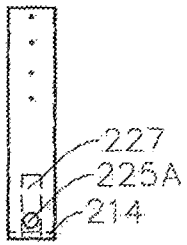
FIG. 12B illustrates an upstream, side elevation view of an alternative embodiment of an upper section of an improved Post 1, showing an anchor cable pass through hole in the upstream side of the post and a notch in the downstream side of the post.
Figure 13A:
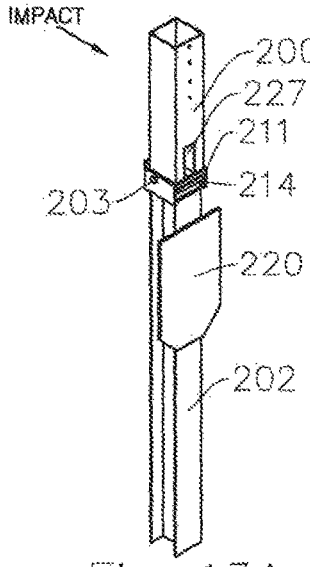
FIGS. 13A-13C illustrate the sequential movement of an embodiment of the upper section of Post 1 upon an end-on impact.
Figure 13B:
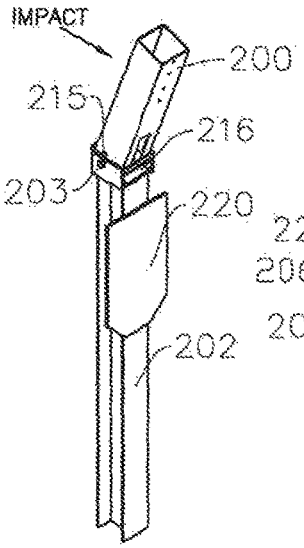
Figure 13C:
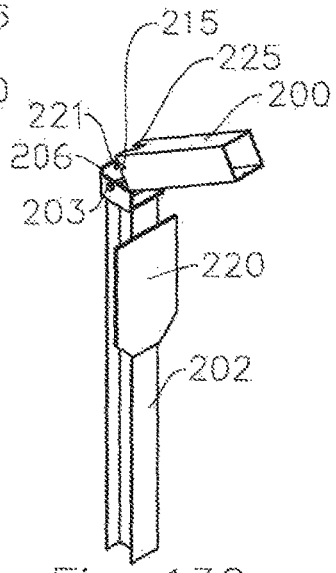
Figure 13D:
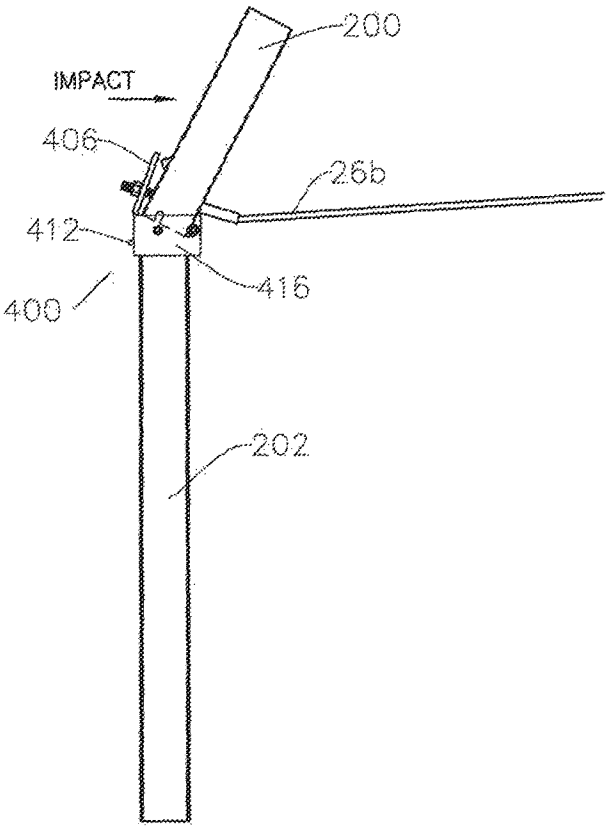
FIG. 13D illustrates a side elevation view of an alternative embodiment of an upper section of an improved Post 1, showing the upper section rotating upon vehicular impact. In this embodiment the anchor cable passes through a notch in the downstream side of the upper post section and a through hole in the upstream side of the upper post section.

Additionally, FIGS. 3C-3$C^3$ illustrate that the height h (FIG. 3B) of opposing, upwardly-extending side plates 414 and 416 on the top 207 of the lower post section 202 are raised to a location above the centerline CL (FIG. 3B) of an anchor cable locking nut 28*a* affixed to the upstream-most end 26*c* of the anchor cable 26*b* when the cable 26*b* passes through through hole 29*b* in plate 406, through through hole 225*a* and notch 227 in upper post section 200 (see FIGS. 12B and 13D).

FIG. 3B' shows a side elevation view of the upstream anchor cable mechanism 400 in rotation with the upper section 200 of Post 1 rotating rearwardly and lifting off of lower post section 202.

Figure 3H:
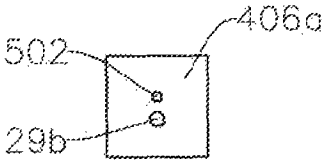
FIG. 3H illustrates the modified anchor bearing plate used in association with the improved upstream anchor cable attachment mechanism (See FIG. 3I).
Figure 3G:
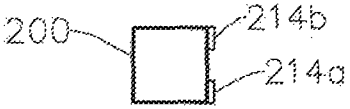
FIG. 3G is a top view of the post section of FIG. 3D showing the sectioned rear strut or strap.
Figure 3F:
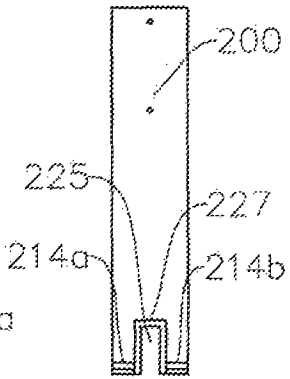
FIG. 3F shows a rear elevation view of the improved, alternative embodiment of the upper section of Post 1 of FIG. 3D showing a rear notch and the sectioned rear strut or strap.
Figure 3E:
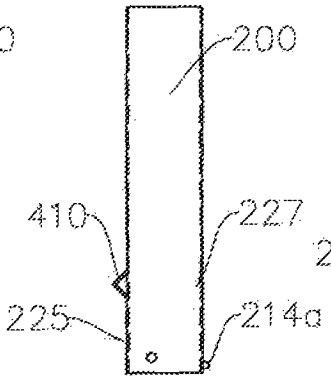
FIG. 3E illustrates a side elevation view of the improved alternative embodiment of the upper section of Post 1 of FIG. 3D showing an angle iron spacer on the upstream side of the post section and a sectioned rear strut on the downstream side.
Figure 3D:
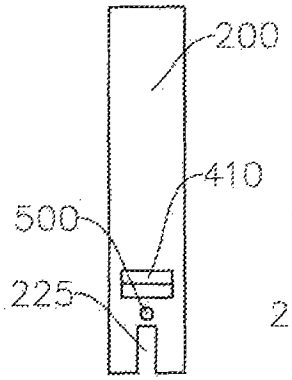
FIG. 3D illustrates a front elevation view of an improved alternative embodiment of the upper section of Post 1 showing a front, lower slot; a bearing plate bolt hole; and the angle iron spacer.

FIG. 3D illustrates a front elevation view of an improved alternative embodiment of the upper section 200 of Post 1, showing a front, lower anchor cable pass through notch 225, an angle iron space 410 affixed to the upstream face of section 200, and an anchor stabilizing bolt hole 500.

Figure 3I:
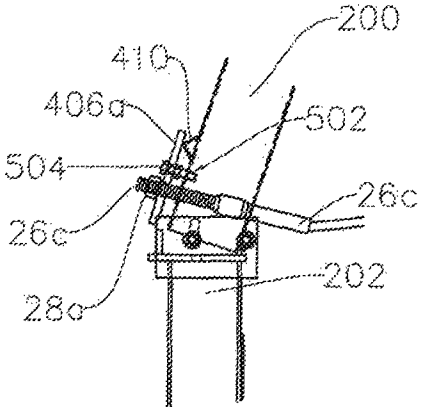
FIG. 3I illustrates a side elevation view of the alternative, improved upstream anchor cable attachment mechanism of FIGS. 3D-3H in rotation with the upper post section of Post 1 rotating and lifting off lower post section of Post 1.

To provide the positive release of the bearing plate 406*a* (FIG. 3I), an additional anchor bolt stabilizing hole 502 is provided through the bearing plate 406*a*. An anchor plate stabilizing bolt 504 (FIG. 3I) may be secured in a manner that protrudes into the stabilizing hole 500 on the upstream face of Post 1 (FIG. 3I).

In an end-on impact, the engagement of bolt 504 with the hole 500 in Post 1 lifts the bearing plate 406*a* off of lower section 202 of Post 1. This improvement involving the cooperation of the bolt 504 with the hole 500 in Post 1 allows upper section 200 of Post 1 and the bearing plate 406*a* to be free to detach, reducing the bulk of the assembly 400. Crash testing with this modified arrangement was successful with no damage to the floor pan of the impacting vehicle.

FIG. 3E shows a side elevation view of a modified upper post section 200 with angle iron space 410 on the upstream face of the section 200. On the downstream face at the bottom of the section 200 is sectioned rear strut or strap 214*a*. FIG. 3G shows, from a top view, the sectioned rear strut (204*a* and 204*b*) along the base of the section 200. It was found that the strut did not need to extend along the entire downstream face, but that the spaced-apart section portions 204*a* and 204*b* still engage the lower post section 202 and function effectively.

The spaced-apart, section portions 204*a* and 204*b* may be seen in FIG. 3F along the lower bottom edge of the section 200. Further, FIG. 3F shows the cable pass through slots or notches 225 (in the upstream face of section 200) and 227 (in the downstream face of section 200).

A modified bearing plate 406*a* is illustrated in FIG. 3H. The additional stabilizer bolt hole 502 is shown above the cable hole 29*b*.

FIG. 3I is similar to FIG. 3B', except that it illustrates the anchor assembly with the stabilizing bolt 504 passing through the bearing plate 406*a* and into the upstream face of upper section 200 of Post 1.

Figure 4:
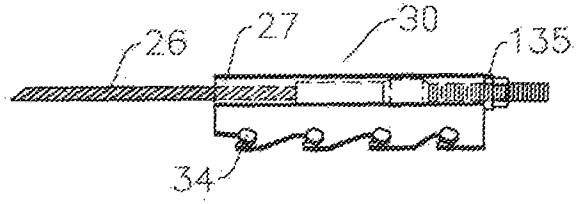
Fig. 4 PRIOR ART
FIG. 4 is an illustration of a prior art anchor cable release bracket showing an anchor cable extending through the anchor cable channel and secured to the downstream end of the bracket.
Figure 5:
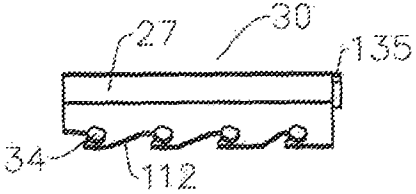
Fig. 5 PRIOR ART
FIG. 5 illustrates the prior art anchor cable release bracket of FIG. 4 without the anchor cable and as it would appear mounted to a W-beam rail element (not shown).

FIGS. 4 and 5 illustrate top views of a prior art anchor cable release bracket 30. Again, the details of the prior art bracket 30 are presented in U.S. Pat. No. 8,448,913 incorporated herein for all purposes. FIG. 4 shows an anchor cable 26 extending through the cable through channel 27 and secured to the downstream end 135 of the bracket.

Figure 4A:
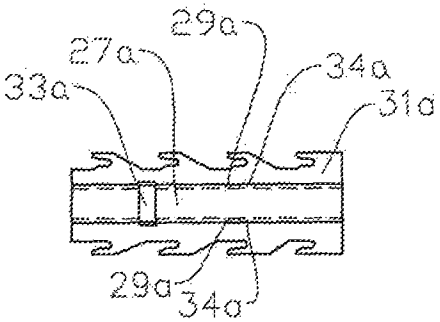
FIG. 4A is a top plan view of an improved anchor cable release bracket of the present invention.
Figure 4B:
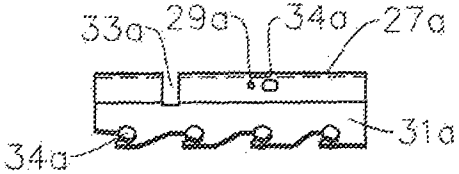
FIG. 4B is a side elevation of an improved anchor cable release bracket of the present invention as it appears when releasably mounted to a W-beam rail element (the W-beam rail element is not shown).

FIG. 5 shows the prior art bracket 30 without the anchor cable but with the mounting bolts 34 in the tapered slots 112 of the bracket 30. Turning to FIGS. 4A-6A details of an improved anchor cable release mechanism 30*a* including the bracket 31*a* and the anchor cable release arm 120 are shown. FIG. 4A is a side elevation view of an improved anchor cable release bracket 31*a*. Bracket 31*a* is similar to the bracket 30 of the prior art, but with several unique design improvements. A yoke slot 33*a*, pivot mounting bolt holes 29*a*, and alignment/retention pin holes 33*a* are provided in the cable through channel 27*a*. The relationship of the elements is shown in the side elevation view of the bracket 31*a* in FIG. 4B as if mounted to a W-beam rail element by mounting bolts 34*a*.

Figure 5A:
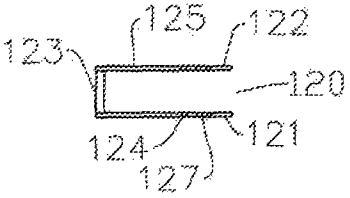
FIG. 5A is a top view of an anchor cable release arm of the present invention.
Figure 5B:
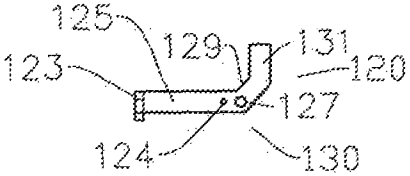
FIG. 5B is a side elevation of the arm of FIG. 5 showing the vertical and horizontal portions of the arm.

FIG. 5A is a side elevation view of an anchor cable release pivot arm 120 of the anchor cable release mechanism 30*a* of the present invention. FIG. 5B is a top view of the pivot arm 120 of FIG. 5A. As seen in FIG. 5A, the pivot arm 120 has two, spaced-apart, L-shaped sides or straps 121 and 122 welded to a cable release yoke 123 on the long ends 125 of the L-shaped straps. The straps also have through bolt holes 127 and alignment retention pin holes 124. A sloping intermediate section 129 of the straps connects the long end 125 to the horizontal end 131.

Figure 6A:
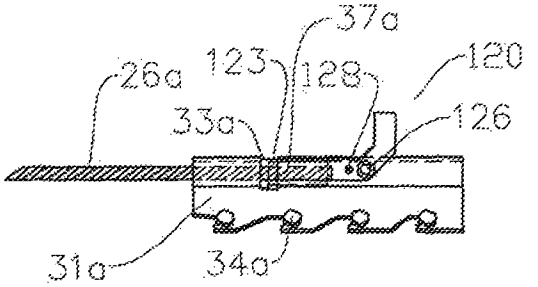
FIG. 6A is a top view of the release mechanism of FIG. 6 with a downstream end of the anchor cable retained in the bracket by the release arm retention yoke releasably securing the cable end.
Figure 6:
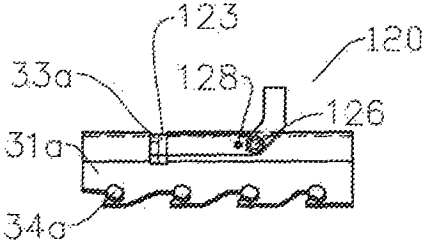
FIG. 6 is a top view of an improved anchor cable release mechanism of the present invention showing the release arm pivotally attached to the bracket body (along the cable through channel) with the anchor cable retention yoke extending into the bracket channel through the release slot in the channel.

The pivot arm 120 is through bolted to the anchor bracket 31*a* at the elbows 130 (FIG. 5B) of the L-shaped straps by bolt 126 and held in place with an alignment/retention pin 128 as shown in FIGS. 6 and 6A.

FIG. 6 is a top view of an improved anchor cable release mechanism 30*a* showing the release pivot arm 120 pivotally attached to the bracket 31*a* with the cable release yoke 123 extending into the cable through channel 27*a* through the release slot or notch 33*a*.

FIG. 6A illustrates a top view of the release mechanism 30*a* of FIG. 6 with the downstream end of the anchor cable 26*a* having a button end cap 37*a* releasably retained in place by the yoke 123.

Other embodiments of an improved cable anchor release mechanism at the downstream end of the cable anchor are shown in FIGS. 19A-19C, 20A-20B, and 21A-21B and will be discussed below.

FIG. 7A-7D illustrate how the improved anchor cable release mechanism 30*a* operates as the feeder chute 48*a* moves downstream along the W-beam rail elements 14*a* upon impact to the terminal head 50.

Figures 7A, 7B, 7C, 7D:
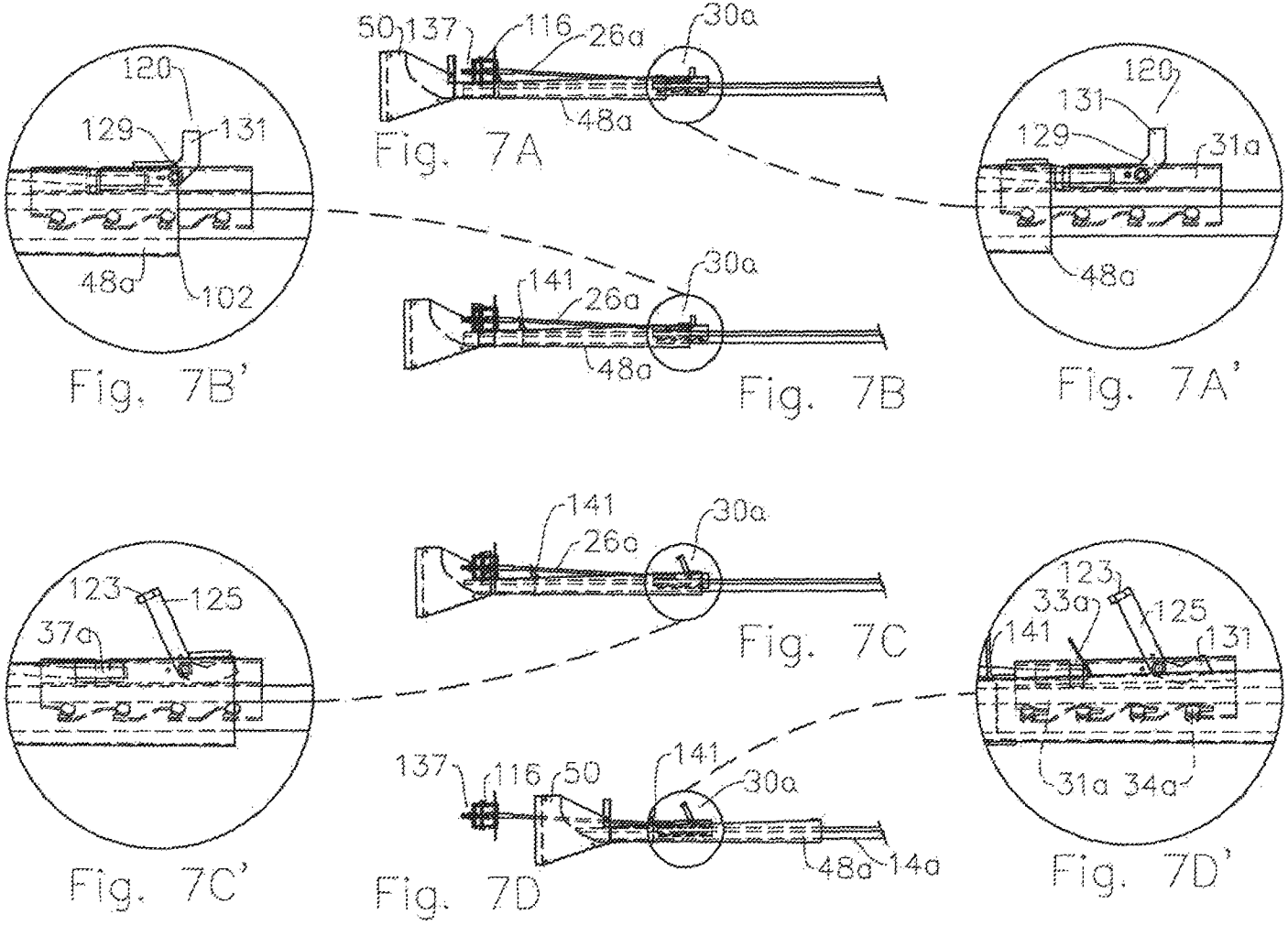
FIGS. 7A-7D illustrate in top views the sequential operation of the improved anchor cable release mechanism as the feeder chute moves downstream along the W-beam rail element upon impact of the terminal impact head.

FIG. 7A and Detail FIG. 7A' illustrate the mechanism 30*a* before a vehicular impact to the terminal head 50. The release pivot arm 120 (FIG. 7A') is a first anchorable retaining position with the long ends 125 generally horizontal and the vertical section 131 generally vertical. In this first position the button cap 37*a* on the downstream end of anchor cable 26*a* is releasably retained in the cable through channel 27*a*. The upstream end 137 of the cable 126*a* is retained in the anchor at the lower section of Post 1.

FIG. 7B illustrates a top view of the guardrail system of FIG. 7A as the impact head and feeder chute are urged downstream upon impact. FIG. 7B and Detail FIG. 7B' show that the downstream end 102 of the chute 48*a* has engaged the sloping intermediate section 129 of the release arm 120. This engagement will cause the arm 120 to pivot with the vertical end 131 rotating downstream and the long ends 129 pivoting and lifting the yoke 123 off the button cap 37*a* of the cable 26*a*.

FIG. 7C shows the further downstream movement of the terminal head and feeder chute. As seen in FIG. 7C and Detail FIG. 7C', the yoke 123 has fully lifted out of slot 33*a*, the cable button cap 37*a* has been released and the cable 26*a* is being released at the downstream end of the cable 26*a* rather than the upstream end 137 as would occur with prior art mechanisms.

A further downstream displacement of the feeder chute and impact head is shown in FIGS. 7D and Detail 7D'. In this further movement downstream, the bracket release shoulder 141 on an upstream end of the feeder chute has engaged the upstream end of the release bracket 31*a* pushing the bracket 31*a* off of the W-beam rail element 14*a*, as would be understood from prior art U.S. Pat. No. 8,448,913. Descriptions relating to the pushing and out-of parallel alignment of the bracket described in U.S. Pat. No. 8,448,913 are incorporated herein for all purposes.

FIG. 8A-8D illustrates perspective views of the sequential operation of the improved anchor cable release mechanism 30*a* as disclosed in FIGS. 7A-7D.

Figure 8B:
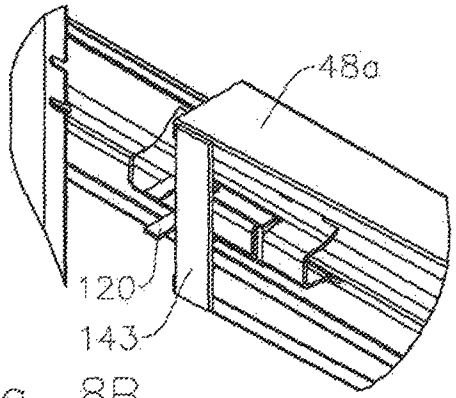
FIGS. 8A-8D are perspective views of the sequential operation of the improved anchor cable release mechanism as the feeder chute moves downstream along the W-beam rail element.
Figure 8D:
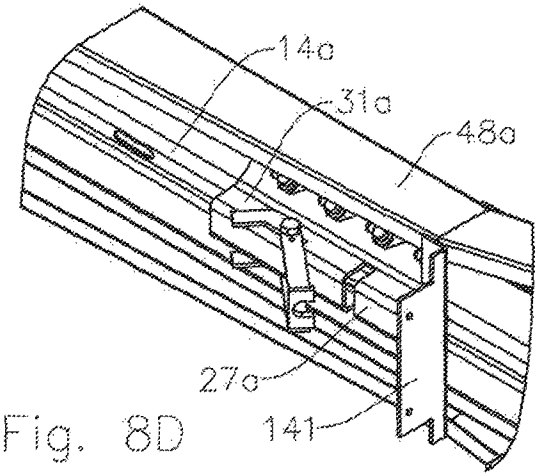
Figure 8A:
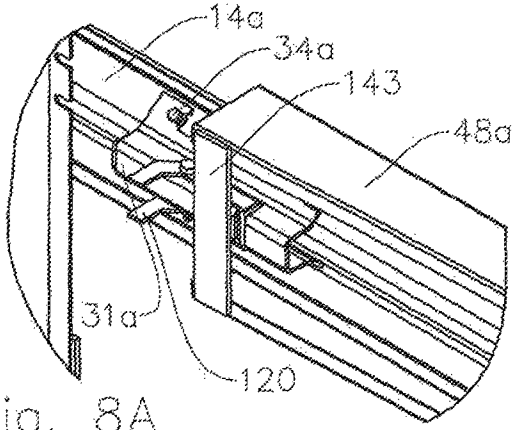

FIG. 8A is a perspective view of the guardrail system of the present invention from the non-traffic side of the guardrail. Strut 143 attached at the downstream most end of the feeder chute 48 is shown in a non-engaging position. The anchor cable bracket 31*a* is mounted to the W-beam rail element 14*a* by mounting bolts 34*a*. The release arm 120 is in a first position with the yoke 123 in the yoke slot 33*a* releasably retaining cable 26*a* in the bracket (Cable 26*a* is not shown for clarification purposes).

As the chute 48*a* moves downstream as shown in FIG. 8B, the strut 143 engages the sloping section 129 of the arm 120 urging the arm to pivot the yoke 123 out of the slot 33*a*.

Figure 8C:
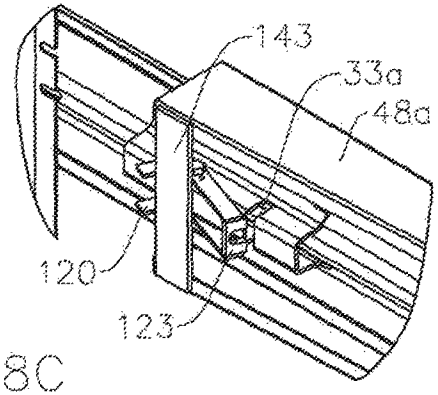
Figure 9A:
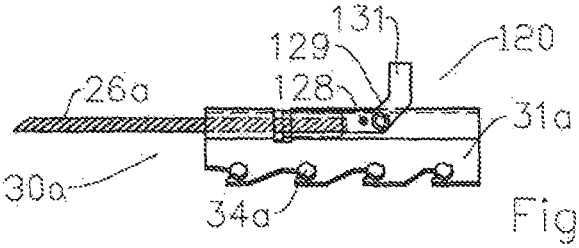
FIGS. 9A-9D are top views of the improved anchor cable release mechanism as the release arm moves from a first position (FIG. 9A) securing the anchor cable within the bracket channel to initial pivoting (FIG. 9C) with the release arm yoke lifting to final pivoting and full release of the cable (FIG. 9D) (The feeder chute is not shown for clarification purposes).
Figure 9B:
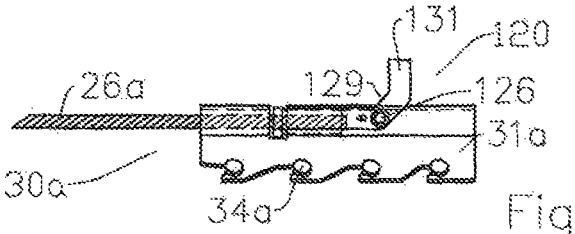
Figure 9C:
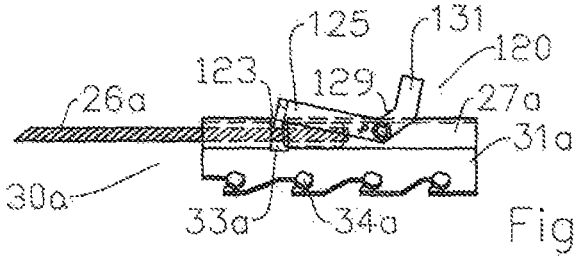
Figure 9D:
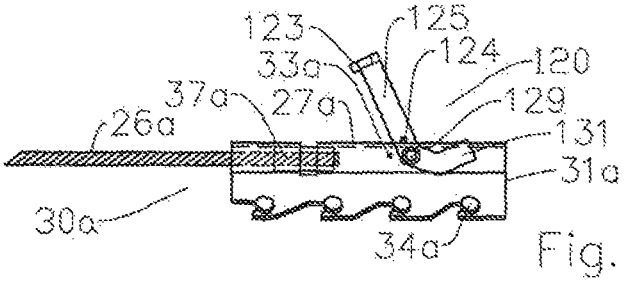

FIG. 8C illustrates how the strut 143 pushes back the arm 120 causing the yoke 123 to lift out of the slot 33*a* and release the cable 26*a* at its downstream end.

FIG. 8D shows the further downstream movement of the feeder chute 48*a* with the bracket release shoulder 141 attached to an upstream end of the feeder chute 48*a* impacting the upstream end of bracket 31*a* urging the bracket 31*a* off of the W-beam rail element 14*a* as previously described.

FIGS. 9A-9D further illustrates the operation of the improved anchor cable release mechanism 30*a* in side elevation views. Corresponding reference numerals shown in FIGS. 7A-7D; Detail FIGS. 7A'-7D' and FIGS. 8A-8D are used in FIGS. 9A-9D. As may be seen (without showing the feeder chute 48*a*) in FIGS. 9A-9D, the cable release mechanism 30*a* of the embodiment of the present invention is very different than the release mechanism of the prior art.

One major benefit of the new lever arm cable release mechanism is the separation of the impulses imparted to the impact head and in turn the impacting vehicle by first releasing the anchor cable from the bracket, and then knocking the bracket off at a much later time. With the prior art anchor cable release design, these two impulses occur within a very short period of time and sometimes the process of knocking the cable anchor bracket off occurs while the cable is still taut, resulting in potential destabilizing of the impact head and impacting vehicle. This problem is resolved by separating the two impulses with the new lever arm cable release mechanisms. Furthermore, it allows more time between initial impact with the impact head and breaking of post 1, thus further separating the impulses imparted on the vehicle.

As discussed above, an embodiment of the present invention provides an improved Post 1 having added lateral strength to accommodate side impacts just downstream of Post 1. FIG. 10 is a perspective view of the assembled Post 1 structure 116*a* of the present invention in a first aligned position. This new Post 1 (116*a*) is seen also in FIGS. 2-2A and FIGS. 7A-7D. In earlier versions, when Post 1 experienced the force of a head-on impact, the post was intended to breakaway. However, the earlier post had limited lateral strength. For side impacts just downstream of Post 1, the earlier post may unintentionally breakaway. One embodiment of an improved Post 1 design 116*a* shown in FIG. 10 has a unique coupling structure 205 at the joinder of upper post section 200 with lower post section 202 which provides additional lateral strength to Post 1 on lateral impacts.

Figure 10A:
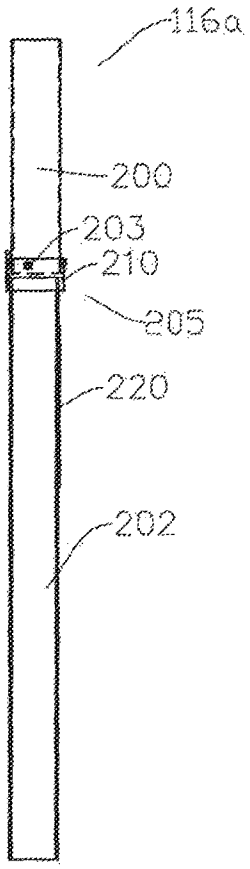
FIG. 10A is a side elevation view of the assembled Post 1 showing the upper and lower post section held together by a retainer bolt.
Figure 10:
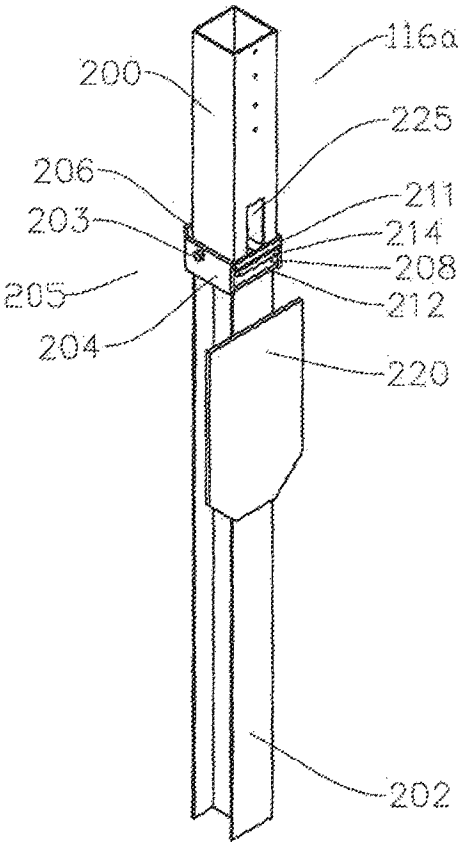
FIG. 10 is a perspective view of an embodiment of the improved Post 1 of the present invention in a first aligned position.

FIG. 10A illustrates a side elevation view of improved Post 1 (116*a*) in a first aligned position with upper post section 200 mounted in a retaining coupling 205 and retained on the top of lower post section 202 by through bolt 203. Retaining coupling 205 is formed by side walls 204, 208; and front side wall 206.

In one embodiment, the back side wall 210 is open except for strut 211 (FIG. 10) which extends between the side walls 204 and 208 above the base 212 of coupling 205. As will be described below, the open space between the lower edge of strut 211 and base 212 forms a coupling space 216 (FIG. 11A) for receiving and retaining the lateral support lip 214 on upper post section 200.

Figures 10C, 10D, 10E:
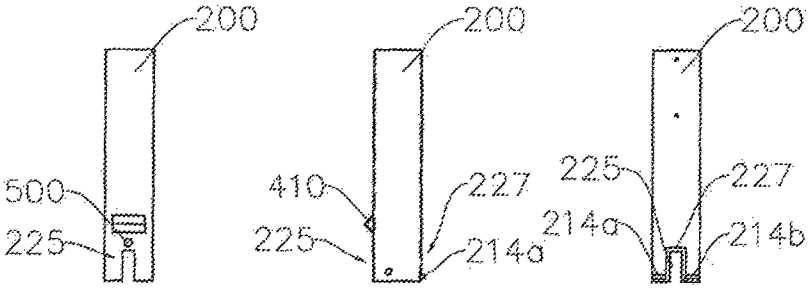
FIGS. 10C-10E illustrate the details of the alternative embodiment of the improved Post 1 of FIG. 10B.
Figure 10F:
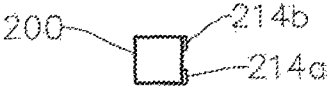
FIG. 10F shows a top view of the post section of FIG. 10B illustrating the sectioned rear strut or strap.
Figure 10H:
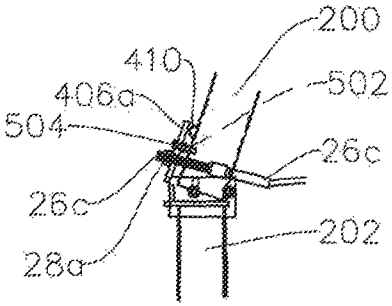
FIG. 10H illustrates a side elevation view of the improved, alternative, upstream anchor cable attachment mechanism of FIG. 10B in rotation, lifting off the lower post section of Post 1.
Figure 10G:
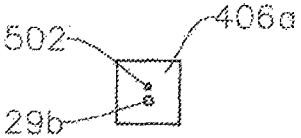
FIG. 10G illustrates the modified anchor bearing plate used with the post of FIG. 10B.
Figure 10B:
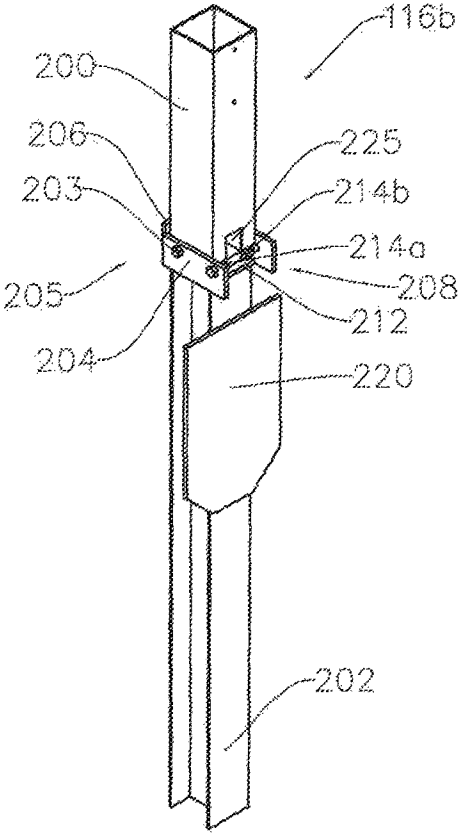
FIG. 10B illustrates a downstream perspective view of an alternative embodiment of the improved Post 1 of the present invention in a first aligned position.

FIG. 10B illustrates a perspective view of an alternative coupling system for modified Post 1 116*a* which improves the disconnecting of the upper section 200 and the lower section 202 on impact. As stated above, in some cases, during an end-on hit, the cable attachment assembly may be caught under the vehicle resulting in tears in the vehicle's floorboard. The alternative coupling system illustrated in FIGS. 10B-10H shows an arrangement of components that reduces or avoids the bulk of the assembly getting caught under the impacting vehicle.

The upper section 200 of Post 1 116*b* is provided with a spacer angle iron 410 on the upstream face of section 200 as seen in FIGS. 10C, 10D and 10H. Also provided through the upstream face is a cable pass through notch 225. To enhance the stability of the bearing plate 406*a* on lip 412, a stabilizing bolt hole 500 is provided above the notch 225 and below the spacer angle iron 410.

FIG. 10E illustrates the downstream side of section 200 showing the rear cable pass through notch 227 and split or spaced-apart strut sections 214*a* and 214*b* extend along the bottom of the section 200 between side walls 204 and 208. The strut or strap does not obstruct the opening at notch 227. These modifications allow the cable with the bearing plate attached to freely detach from Post 1 116*b* after release during an end-on impact. The sectioned, spaced-apart struts 214*a* and 214*b* act as lateral stabilizing members when engaged with lower post section 202. However, since they do not extend entirely across the notch 227, the cable 26*c* more easily detaches from Post 1. FIG. 10F illustrates the sectioned strut 214*a* and 214*b* along the downstream face of section 200.

FIG. 10H shows the upper section 200 of Post 1 116*b* rotating from and lifting off section 202 upon end-on impact. FIG. 10H illustrates how stabilizer bolt 504 passes through bolt hole 502 (FIG. 10G) and through hole 500 in upper section 100. In an end-on impact, the engagement of the bolt 504 with the hole 500 in the upper section lifts the bearing plate 406*a* of the lower section 200. After this, Post 1 116*b* upper section 200 and the cable bearing plate 406*a* are free to detach reducing the bulk of the cable release assembly. Crash tests have confirmed that this improvement has been successful with no damage to the floor pan of the impacting vehicle.

Figure 11A:
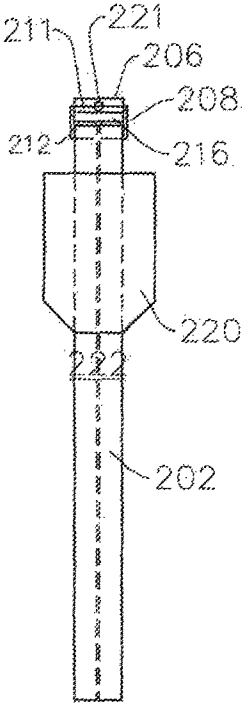
FIG. 11A is a downstream side elevation view of the lower section of the improved Post 1 shown in FIG. 11 (FIG. 11 rotated 90° clockwise).
Figure 11:
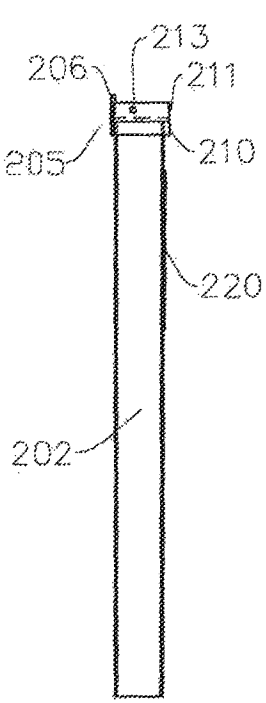
FIG. 11 is a side elevation view of a lower section of an embodiment of an improved Post 1.

FIG. 11 is a side elevation view of the lower section 202 of post 116*a* showing the retaining coupling 205, strut 211, front side wall 206 and back side wall 210, and bolt hole 213. FIG. 11A is a downstream elevation view of the lower section 202 of the post 116*a* showing an anchor cable through hole 221 in front side wall 206, strut 211 extending from side wall 204 to side wall 208 above coupling base 212 thereby forming coupling space 216. A resistance plate 220 is welded to the downstream face 222 of post section 202 and provides resistance to the movement or rotation of the lower section 202 when the post 116*a* is disposed in the soil. The upper post section 200 is shown in a side elevation view in FIG. 12. Lateral support strut or strap 214 is shown welded to the lower edge of section 200, bolt hole 215 cooperates and aligns with bolt hole 213 to receive and retain connecting bolt 203 when the post sections 200 and 202 are assembled.

Figure 12A:
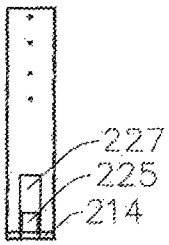
FIG. 12A is a downstream, side elevation view of the upper section of improved Post 1 shown in FIG. 12 (FIG. 12 rotated 90° clockwise).
Figure 12:
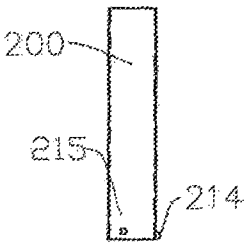
FIG. 12 is a side elevation view of an upper section of an embodiment of an improved Post 1.

FIG. 12A is a downstream side elevation view of the upper section of Post 116*a* shown in FIG. 12, but rotated 90° clockwise. Lateral support lip 214 is shown welded on the bottom of upper post section 200. Lip 214 is a unitary strut or strap which spans across notch 227. Cable through notches which allow anchor cable 26*a* to pass through and be secured to plate 206 on lower post section 202 are seen in FIG. 12A. Notch 225 is in the front wall of the upper post section while notch 227 is in the back wall of the upper post section.

In an alternative embodiment of the present invention and as seen in FIG. 12B, upper post section 200 is provided with a through hole 225A rather than a notch 225. (Compare FIG. 12A with FIG. 12B.) The embodiment of FIG. 12B is used in cooperation with the anchor cable attachment 400 shown in FIGS. 3B-3C$^3$.

FIGS. 13A-13C illustrate the sequential movement of the upper post section 200 during an end on impact. The impacting forces cause the upper post section 200 to breakaway and rotate downstream. As may be seen in FIGS. 13B and 13C, the lateral support lip 214 rotates out of coupling space 216 and upper post section 200 is lifted free from the bolt 203 by tearing through the lower lip of the bolt hole 215. This is how the upper section 200 is broken from the lower section.

FIG. 13D illustrates an alternative embodiment to the embodiment of FIGS. 13A-13C. In FIG. 13D it may be seen that the anchor cable passes through notch 227 and through hole 225*a* in upper post section 200. The anchor bearing plate 406 raises off of the lip or ledge 412 as the upper post section 200 is pulled out from between opposing, upwardly extending side walls 414 and 416 and begins separation from lower post section 202.

Figure 13G:
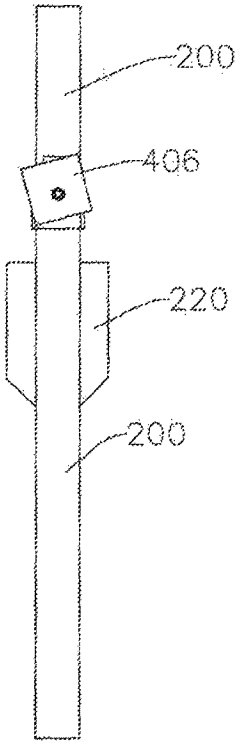
FIGS. 13E-13G show how an anchor plate rests on a ledge extending upstream from the face of the lower section of the post. The plate is prevented from rotation by the cooperation of the ledge or shelf and the lower edge of the plate.
Figure 13F:
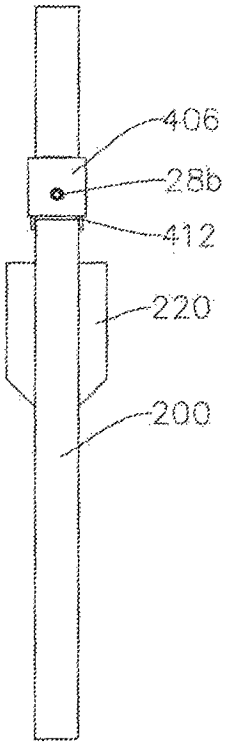
Figure 13E:
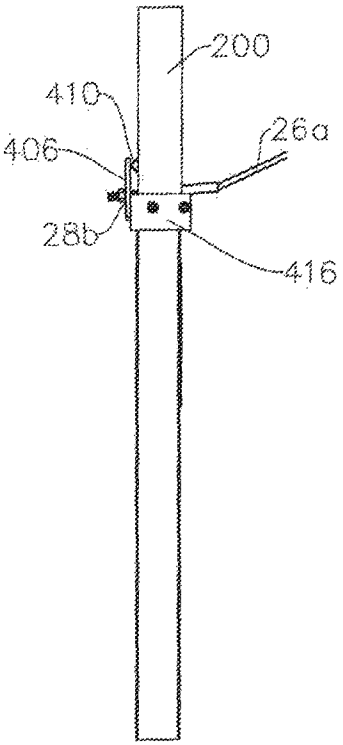
Figures 14A, 14B, 14C, 14D:
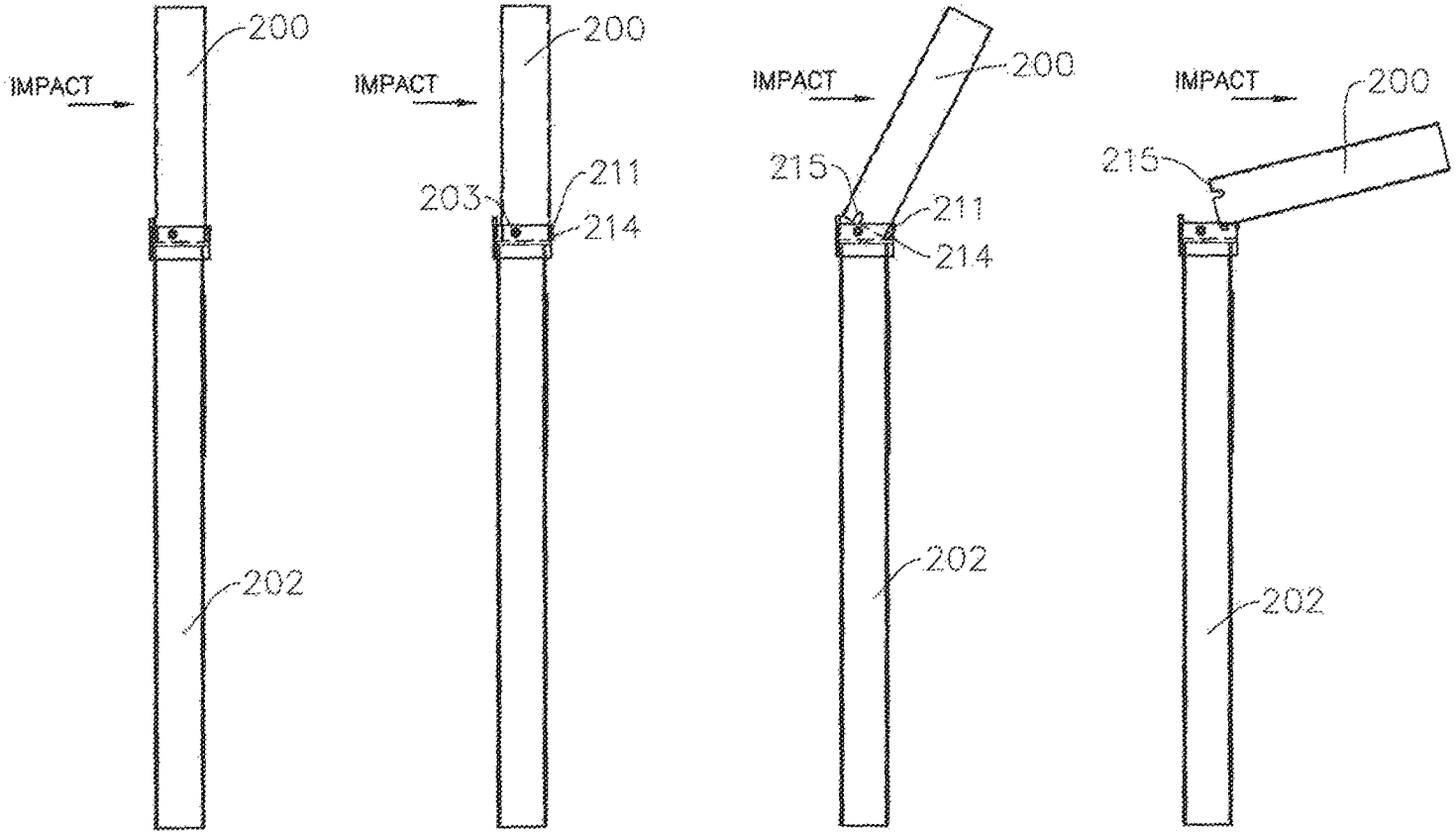
FIG. 14A-14D illustrate, in side elevation views, the movement of the upper section of Post 1 relative to the lower section upon impact of a vehicle.

FIGS. 13E-13G illustrate how the anchor bearing plate 406 cooperates with ledge 412 to avoid rotation of the plate 406, thereby potentially reducing the anchorage capacity of the system.

FIGS. 13H, 13I, and 13H' illustrate a modified upper section 200, as previously detailed in FIGS. 10B-10H, showing how the anchor bearing plate 406*a* cooperates with ledge 412 to avoid rotation of the plate 406*a*. The stabilizing bolt 504 further enhances the avoidance of rotation of the plate 406*a*.

FIGS. 14A-14D show, in side elevation view, the sequential movement of the breakaway of the upper post section 200 from the lower post section 202 upon an end-on impact in one embodiment of the present invention.

The design of one embodiment of the improved Post 1 (116*a*) is similar to prior art Post 1 except for the two "blocker" plates on the downstream side of the post assembly. These "blocker plates" are cooperating strut 211 and lateral support lip 214. Lateral support lip 214 is welded to the bottom of the upper post section 200 as seen in FIGS. 10, 12, and 12A. When in the first aligned, assembled position shown in FIGS. 10 and 10A, the lip 214 fits within the coupling space 216 (FIG. 11B) beneath support lip 214 and the retaining coupling base 212.

When a modified bearing plate 406*a* is used with another embodiment of upper section 200 of Post 1 116*b*, the stabilizing bolt 504 passes through the plate and engages with the upstream face of the upper post section 200 stabilizing the plate on lip or ledge 214. On the downstream side of upper section 200 of Post 1 116*b*, one of the "blockers," namely, the lateral support lip, is segmented, spaced-apart strut sections 214*a* and 214*b*. It was found that having the lip in two, spaced-apart sections, not obstructing notch 227, improved the detachment of the upper section from the lower section as discussed above.

In the embodiment illustrated in FIGS. 3B, 3C-3G$^3$, 12B, and 13D, not only are the "blocker" plates utilized, but the anchor cable 26*b* passes through a through hole 225*a* in the upper post section 200 and an anchor bearing plate 406 cooperates with a ledge 412 and raised sidewalls 414 and 416 to control the separation of the upper section 200 from the lower section 202.

Figure 15C:
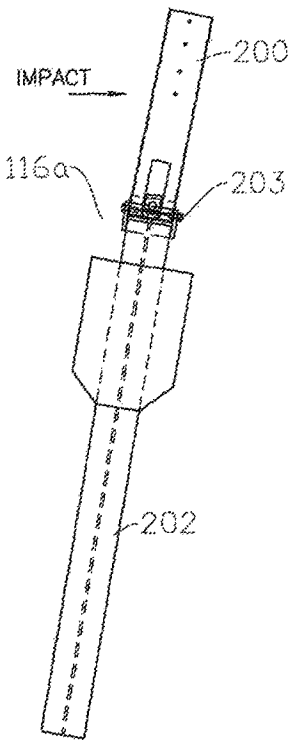
FIGS. 15A-15C illustrate the lateral strength of the improved Post 1 to side impacts at Post 1. The upper and lower sections of Post 1 remain engaged during lateral impact.
Figure 15B:
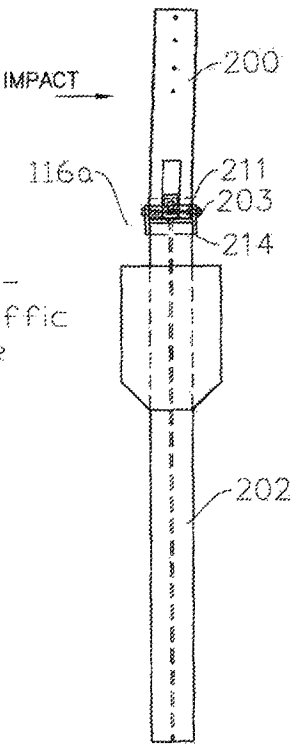
Figure 15A:
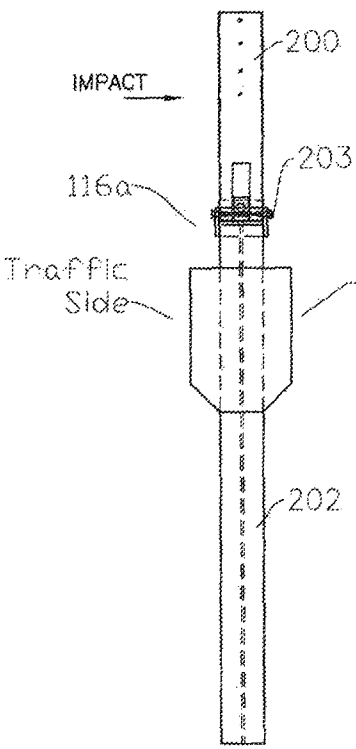

FIGS. 15A-15C illustrate in downstream, side elevation views the effect of improving lateral strength of improved post 116*a*. During a side impact, the upper post section 200 of the post 116*a* will begin to rotate laterally toward the non-traffic side of the post 116*a*. As may be seen in FIG. 15B, as the upper section 200 begins to rotate lateral support lip 214 is held in the coupling space 216 by strut 211 and resists lateral rotation of the upper section 200. In FIG. 15C it may be seen that the entire post 116*a* has rotated laterally to the non-traffic side, but the upper section 200 has not broken away. In FIG. 15C lateral loading has been transmitted to the lower section 202 and soil (not shown) through both the bolt 203 connection and the cooperation of the "blocker" plates (lip 214 and strut 211), thus greatly increasing the lateral strength of post 116*a*.

It should be understood that the cable anchor attachment mechanism 400 also provides improved lateral support strength to the breakaway post because of the raised, upwardly extending side walls 414 and 416.

Figure 16A:
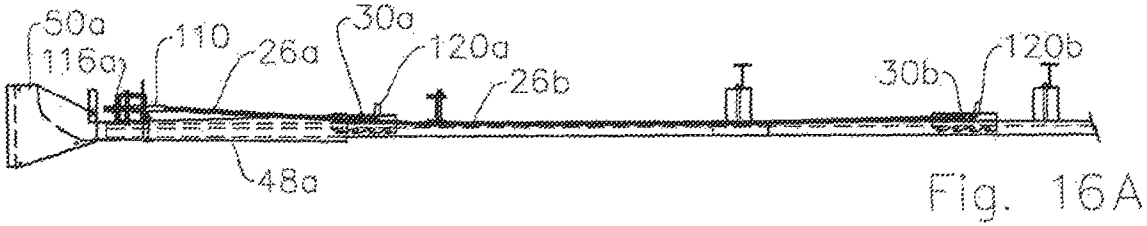
FIG. 16A shows a top view of the guardrail system of FIG. 16.
Figure 16:
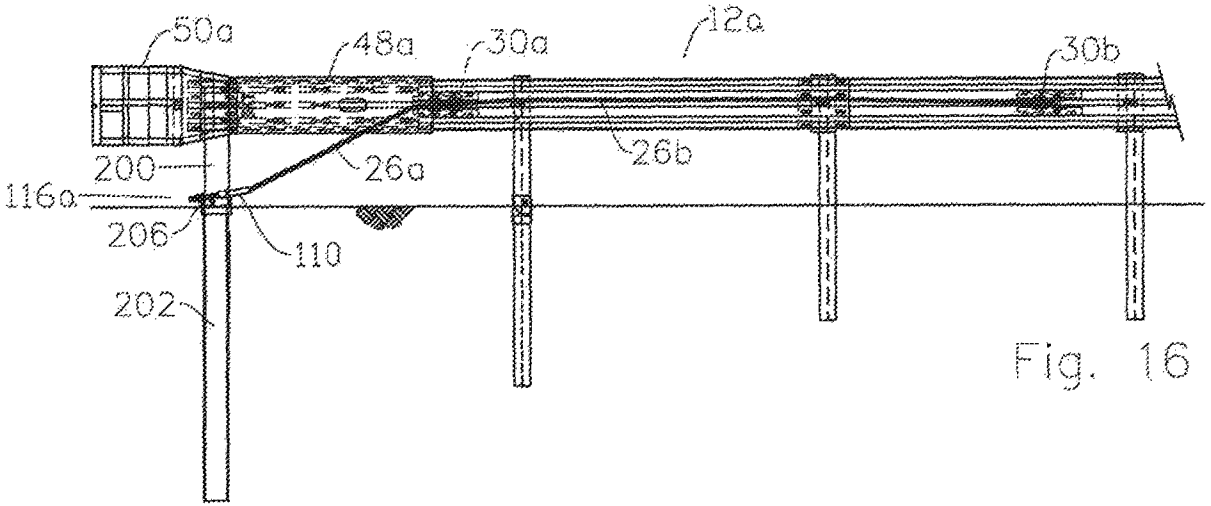
FIG. 16 is a side elevation view of a guardrail system of the present invention showing two spaced-apart anchor cable release mechanisms disposed on sections of the W-beam rail elements.

Using the improved anchor release mechanism design described above in relation to FIGS. 7A-7D; Detail FIGS. 7A'-7D'; FIGS. 8A-8D'; and FIGS. 9A-9D, it should be understood that a multiplicity of such mechanism may be used in combination to maintain tension in the W-beam rail guardrail system. FIGS. 16 and 16A illustrate an example of the use of two anchor cable release mechanisms 30*a* and 30*b* to maintain tension in the guardrail 12*a*.

In FIGS. 16 and 16A, an additional length of anchor cable 26*b* has been swagged together at a first upstream end with first cable 26*a* to span from Post 1 (116*a*), through the first anchor cable release mechanism 30*a* to the second, downstream mechanism 30*b*. The second downstream end of the additional length of anchor cable 26*b* is releasably held in the second mechanism 30*b*. The upstream end 110 of anchor cable 26*a* is attached permanently to the front side wall 206 of the lower portion 202 of post 116*a*.

Once an impacting vehicle pushes the head 50*a* downstream, it breaks away the upper post section 200, and the feeder chute 48*a* moves downstream and engages the first release lever arm 120*a* thereby disconnecting cable section 26*a* from the first cable release mechanism 30*a*. However, since cable 26*a* is swagged to cable 26*b* which is still held in place by the second cable release mechanism 30*b*, tension in the anchor cable 26*a* and 26*b* and the W-beam rail 12*a* is maintained.

The feeder chute 48*a* continues downstream and pushes the first cable release bracket 30*a* from the upstream W-beam rail section 12*a*. When the feeder chute 48*a* reaches the second cable release mechanism 30*b*, it engages the second release arm 120*b*, and the entire anchor cable (26*a* swagged to 26*b*) is released at the downstream end at mechanism 30*b*. The tension in the W-beam rail 12*a* is maintained through the release of subsequent cable release mechanisms thereby reducing the propensity for W-beam rails to buckle and form elbows adversely effecting the operation of the guardrail system and the safety of the impacting vehicle.

Figure 17A:
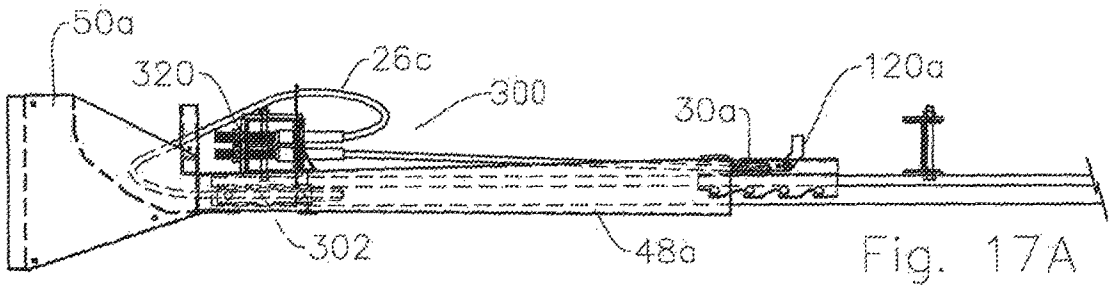
FIG. 17A is a top view of the guardrail system of FIG. 17.
Figure 17:
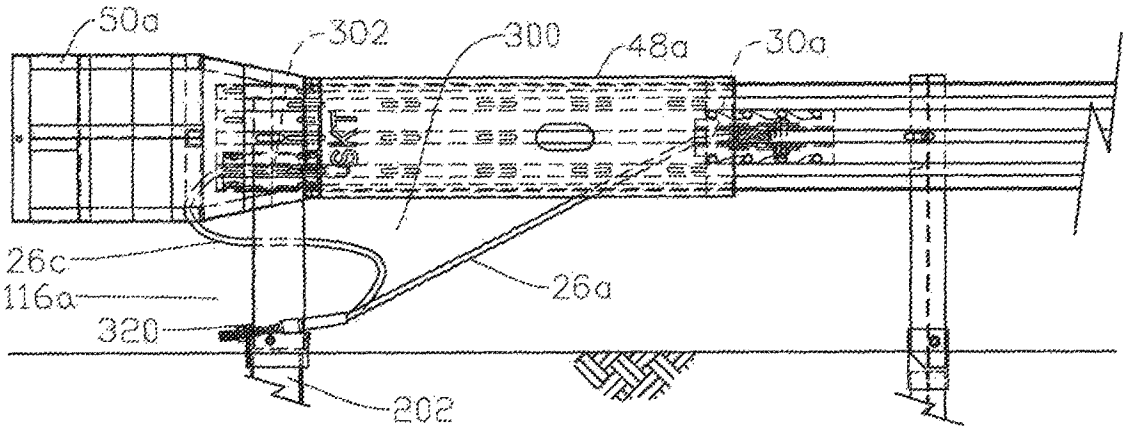
FIG. 17 is a side elevation view of a guardrail system of the present invention showing a supplement anchor cable attached to the anchor post on Post 1 with the supplemental cable passing through the impact terminal head and attached to the upstream end of the W-beam rail element in the feeder chute.

In an embodiment of the present invention shown in FIGS. 17; 17A; 18; and 18A, a supplemental cable anchor mechanism 300 is provided to maintain tension in the W-beam rail after release of the primary anchor cable 26*a*. FIGS. 17 and 17A illustrate a supplemental cable anchor mechanism 300 with anchor cable 26*c* attached at an upstream end to the same front side plate 320 (attached to the lower post section Post 1 (116*a*)) as the primary anchor cable 26*a*.

A front side plate 320 (FIG. 17A) with two drilled holes allows for the attachment of both anchor cables 26*a* and 26*c* to the same anchor post at post 116*a*. Note that the front side plate 320 is similar to the front side plate 206 in FIGS. 2, 2A, 11, and 16 which has a single drilled hole for anchor cable 26*a*

Figure 18A:
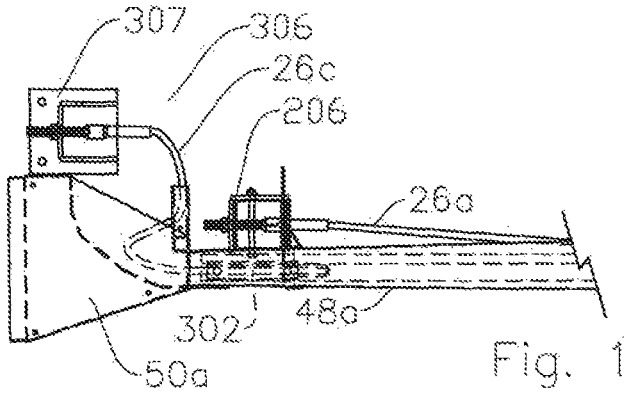
FIG. 18A is a top view of the guardrail system of FIG. 18.
Figure 18:
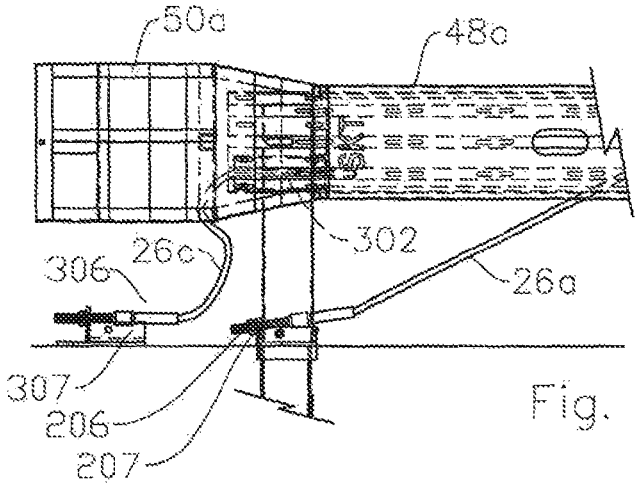
FIG. 18 illustrates side elevation view of a guardrail system of the present invention with the anchor post disposed upstream of Post 1 rather than on Post 1 as shown in FIG. 17.

Alternatively, as seen in FIGS. 18 and 18A, an additional and separate cable anchor mechanism 306 may be installed upstream of post 116*a*. The anchor 306 may consist of a lower post portion 202, similar to that of post 116*a*, or a cable anchor bracket 307 as shown in FIGS. 18 and 18A. The supplemental anchor cable 26*c* extends through the impact head 50*a* and the downstream end of the cable 26*c* is retained by a bracket 302 bolted to the upstream end of the W-beam rail element.

It should be understood that sufficient slack is provided in supplemental cable 26*c* so that the cable is not tensioned initially after the primary anchor cable 26*a* is released from the release mechanism 30*a* attached to the downstream W-beam rail. As the impact head 50*a* is pushed further downstream by the impacting vehicle, the slack in the cable 26*c* is taken up and the supplemental cable 26*c* becomes taut at which time the W-beam rail is again under tension. This tension is maintained until the supplemental cable 26*c* is released from the W-beam bracket 302 attached to the upstream end of the W-beam rail. This supplemental anchor system in effect lengthens the time the W-beam rail is under tension, allowing the impact head 50*a* to travel further downstream before tension in the W-beam rail is fully released.

In an end-on impact, the primary anchor cable 26*a* would first be released as the feeder chute 48*a* impacts the release arm 120*a*. Tension in the W-beam rail would be released momentarily until the slack in the supplemental anchor cable 26*c* is taken up and the supplemental cable 26*c* becomes taut.

Turning now to FIGS. 19A-19C, 20A-20B, and 21A-21B, other embodiments of an improved cable anchor release mechanism at the downstream end of the cable anchor are disclosed.

Figure 19C:
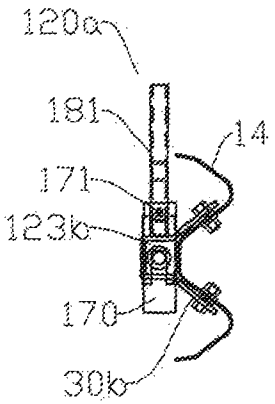
FIG. 19C is an end view of the mechanism of FIG. 19A mounted to non-traffic side of the W-beam rail element
Figure 19A:
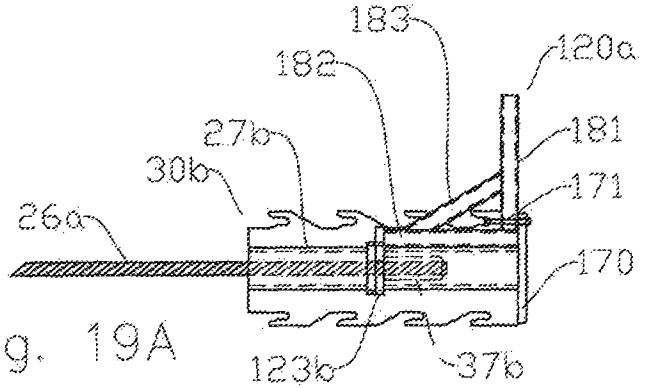
FIG. 19A is a side elevation view of an alternative embodiment of an improved anchor cable release mechanism of the present invention showing a pivot arm pivotally attached to the bracket body
Figure 19B:
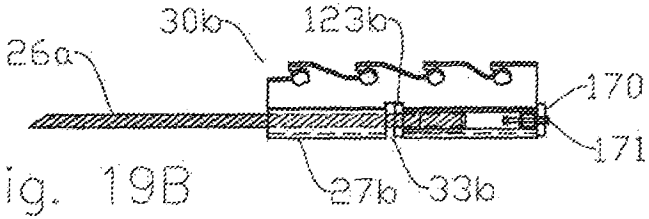
FIG. 19B is a top view of the embodiment of FIG. 19A partially showing the mechanism with mounting bolts for attaching the mechanism to the W-beam rail element (not shown)

FIGS. 19A-19C show an embodiment similar to the improved cable anchor release mechanism described in FIGS. 3 through 9. The mechanism consists of: a yoke slot 33*b* in the anchor cable release bracket 30*b*, a pivot arm 120*a*, and an end plate 170 welded to the downstream end of the channel 27*b* of the cable release bracket 30*b*. The pivot arm 120*a* is fabricated from steel tubing, with a vertical arm 181 welded to the downstream end of a horizontal member 182, and reinforced with a diagonal brace 183. A cable release yoke 123*b* is welded to the upstream end of the horizontal member 182. A bolt 171 is used to hold the pivot arm 120*a* to the end plate 170, but not firmly attached, i.e., the length of the bold is considerably longer than the combined thickness of the vertical arm 181 of the pivot arm and the end plate 170. The anchor cable 26*a* passes through the channel 27*b* and the cable button cap 37*b* is held in place by the cable release yoke 123*b*.

In an end-on impact, the impact head and feeder chute are urged downstream. The downstream end 102 of the chute 48*a* will engage the vertical arm 181 of the pivot arm 120*a*. The engagement will cause the pivot arm to rotate about the bolt 171 attachment to the end plate 170. As the pivot arm 120*a* rotates, the cable release yoke 123*b* is lifted off the button cap 37*b* of the cable 26*b* and release the anchor cable.

Figure 20B:
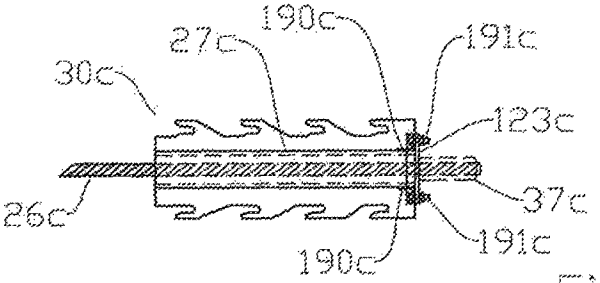
FIG. 20B is a side elevation view of another alternative embodiment of an improved anchor cable release mechanism of the present invention with mounting bolts for attaching the mechanism to the W-beam rail element.
Figure 20A:
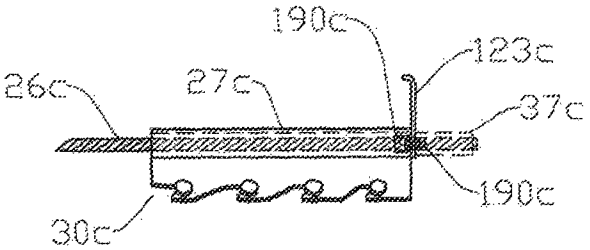
FIG. 20A is a top plan view of the embodiment of FIG. 20A without showing the mounting bolts.

Another embodiment of an improved cable anchor release mechanism is shown in FIGS. 20A-20B. Two angle tabs 10*c* are welded to the downstream end of the channel 27*c* of the anchor cable release bracket 30*c*, one on each side of the channel. A cable release yoke 123*c* is attached to the two tabs 190*c* with two bolts 191*c*. The anchor cable 26*c* passes through the channel 27*c* and the cable button cap 37*c* is held in place by the cable release yoke 123*c*.

In an end-on impact, the impact head and feeder chute are urged downstream. The downstream end 102 of the chute 48*a* will engage the cable release yoke 123*c*. The engagement will cause the two bolts 191*c* holding the cable release yoke 123*c* to the tabs 190*c* to fail or for the welds on the tables 190*c* to fail, thus releasing the yoke. The yoke will then rotate and lift off the button cap 37*c* of the cable 26*c* and release anchor cable.

Figure 21B:
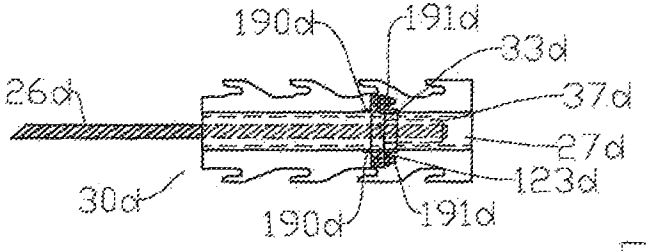
FIG. 21B illustrates a side elevation view of yet another alternative embodiment of an improved anchor cable release mechanism of the present invention with mounting bolts for attaching the mechanism to the W-beam rail element.
Figure 21A:
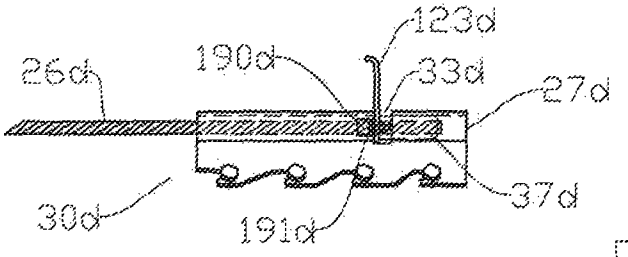
FIG. 21A shows a top plan view of the embodiment of FIG. 21A without showing the mounting bolts.

In yet another embodiment shown in FIGS. 21A-21B, a yoke slot 33*d* is provided in channel 27*d* for the cable release yoke 123*d*. The two angle tabs 190*d* are welded to the channel 27*d* just upstream of the yoke slot 33*d*. The cable release yoke 123*d* is attached to the two tabs 190*d* with two bolts 191*d*. The anchor cable 26*d* passes through the channel 27*d* and the cable button cap 37*d* is held in place by the cable release yoke 123*d*.

The function of the cable release mechanism is similar to the mechanism previously described under FIGS. 20A-20B. Note that the placement of the yoke slot 33*d* along the length of the channel 27*d* may be varied to control the time at which the cable release yoke will be engaged by the downstream end 102 of the chute 48*a*.

The embodiments described herein are some examples of the current invention. Various modifications and changes of the current invention will be apparent to persons of ordinary skill in the art. Among other things, any feature described for one embodiment may be used in any other embodiment. The scope of the invention is defined by the attached claims and other claims to be drawn to this invention, considering the doctrine of equivalents, and is not limited to the specific examples described herein.

What is claimed is:

1. A highway crash attenuation system having W-beam rail elements attached to a plurality of vertical posts; an impact terminal having a feeder chute for guiding one or more of said W-beam rail elements through said impact terminal; and a first anchor cable extending from a first breakaway post anchor to an anchor cable release mechanism releasably attached to at least one of said W-beam rail elements downstream of said first breakaway post anchor, said first breakaway post comprising:

an upper post section and a lower post section, said upper post section having a first anchor cable through notch in an upstream wall of said upper post section and a second notch in a downstream wall of said upper post section, said anchor cable passing through said first notch in said upstream wall and said second notch in said downstream wall;

spaced-apart sections of lateral support lips extending along a lower edge of a downstream face of said upper post section, said spaced-apart support lip sections having a space therebetween such that a cable pass through opening in said second notch is unobstructed;

a cable anchor bearing plate engaged with an upstream face of said upper post section, said bearing plate having a first anchor cable through hole through which said anchor cable is adapted to pass and be retained therein by a locking nut affixed to an upstream most end of said anchor cable, wherein said bearing plate is disposed at a predetermined angle with respect to said first breakaway post by engaging a spacer between a top end of said plate and an upstream face of said upper post; and an anchor bearing stabilizing bolt extending through a second hole in said bearing plate and secured in a stabilizing hole in said upstream face of said upper post section.

2. The highway crash attenuation system of claim 1, wherein said spacer is a section of angle iron joined with said upstream face of said upper section of said post.

3. The highway crash attenuation system of claim 1, wherein said anchor cable release mechanism further comprising: a ledge on top of said lower section of said post, said ledge extending under said cable anchor bearing plate to provide a shelf for supporting said bearing plate and preventing rotation of said cable anchor bearing plate.

4. The highway crash attenuation system of claim 3, wherein said upstream-most end of said anchor cable remains retained by said cable anchor bearing plate after vehicular impact separating said upper post section from said lower post section.

5. The highway crash attenuation system of claim 1 further comprising a supplemental cable anchor system for maintaining tension on said W-beam rail element after said first anchor cable is released from said anchor cable release mechanism.

6. The highway crash attenuation system of claim 5 wherein said supplemental cable anchor system has a second anchor member upstream from said first breakaway post anchor, said system having a second anchor cable extending from said second anchor member to a bracket affixed to one of said W-beam rail elements.

7. The highway crash attenuation system of claim 1 further comprising:

an additional length of anchor cable attached at an upstream end to said downstream end of said first length of cable and attached at a second downstream end to a second cable release bracket releasably attached to a second W-beam rail element, said second cable release bracket having a cable through channel for receiving and releasably retaining said second downstream end of said additional length of anchor cable.

* * * * *